US008893789B2

(12) United States Patent
Cunningham et al.

(10) Patent No.: US 8,893,789 B2
(45) Date of Patent: Nov. 25, 2014

(54) SHUNT TUBE CONNECTION ASSEMBLY AND METHOD

(75) Inventors: Gregory Scott Cunningham, Grapevine, TX (US); Brandon Thomas Least, Dallas, TX (US); Stephen Michael Greci, McKinney, TX (US); Jean Marc Lopez, Plano, TX (US); Jan Veit, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/882,457

(22) PCT Filed: Jun. 11, 2012

(86) PCT No.: PCT/US2012/041970

§ 371 (c)(1),
(2), (4) Date: Apr. 29, 2013

(87) PCT Pub. No.: WO2013/187878

PCT Pub. Date: Dec. 19, 2013

(65) Prior Publication Data

US 2014/0014314 A1 Jan. 16, 2014

(51) Int. Cl.
*E21B 43/04* (2006.01)
*E21B 43/08* (2006.01)

(52) U.S. Cl.
CPC ..... *E21B 43/04* (2013.01); *E21B 43/08* (2013.01)
USPC ..... 166/278; 166/51; 166/242.3

(58) Field of Classification Search
USPC ..... 166/242.3, 236, 278, 51; 285/148.18, 285/148.22, 148.23
See application file for complete search history.

(56) References Cited

U.S. PATENT DOCUMENTS

| | | | | |
|---|---|---|---|---|
| 3,126,215 | A * | 3/1964 | Raskin | 285/148.22 |
| 3,895,830 | A * | 7/1975 | Madlem | 285/150.1 |
| 4,147,382 | A * | 4/1979 | Wachter | 285/189 |
| 5,113,935 | A | 5/1992 | Jones et al. | |
| 5,364,136 | A * | 11/1994 | Forti et al. | 285/148.22 |
| 5,515,915 | A | 5/1996 | Jones et al. | |
| 7,108,060 | B2 * | 9/2006 | Jones | 166/177.5 |
| 7,363,974 | B2 | 4/2008 | Wang et al. | |
| 7,493,959 | B2 * | 2/2009 | Johnson et al. | 166/380 |
| 8,245,789 | B2 | 8/2012 | Holderman et al. | |
| 2002/0174984 | A1 * | 11/2002 | Jones | 166/278 |

(Continued)

FOREIGN PATENT DOCUMENTS

| | | | |
|---|---|---|---|
| JP | 2001133078 | A | 5/2001 |
| WO | 2013187877 | A1 | 12/2013 |

OTHER PUBLICATIONS

Foreign Communication from a Related Counterpart Application, International Search Report and Written Opinion dated Feb. 19, 2013, International Application Serial No. PCT/US12/41970, filed on Jun. 11, 2012.

Foreign Communication from a Related Counterpart Application, International Search Report and Written Opinion dated Feb. 1, 2013, International Application Serial No. PCT/US2012/041968, filed on Jun. 11, 2012.

(Continued)

*Primary Examiner* — Robert E Fuller

(57) ABSTRACT

A shunt tube assembly comprises a shunt tube and a jumper tube comprising a first end. The shunt tube comprises a non-round cross section, and the first end of the jumper tube is coupled to the shunt tube at a coupling. The first end of the jumper tube comprises a substantially round cross section at the coupling.

19 Claims, 17 Drawing Sheets

(56) References Cited

U.S. PATENT DOCUMENTS

| | | | |
|---|---|---|---|
| 2006/0283604 | A1 | 12/2006 | Setterberg, Jr. et al. |
| 2009/0159270 | A1 | 6/2009 | Setterberg, Jr. et al. |
| 2010/0032158 | A1 | 2/2010 | Dale et al. |
| 2012/0048536 | A1 | 3/2012 | Holderman et al. |
| 2012/0160474 | A1 | 6/2012 | Holderman et al. |
| 2013/0327542 | A1 | 12/2013 | Least et al. |
| 2014/0008066 | A1 | 1/2014 | Least et al. |

OTHER PUBLICATIONS

Cunningham, Gregory Scott, et al., "Shunt Tube Connection and Distribution Assembly and Method", filed on Mar. 11, 2013, U.S. Appl. No. 13/822,292.

* cited by examiner

SHUNT TUBE CONNECTION ASSEMBLY AND METHOD

CROSS-REFERENCE TO RELATED APPLICATIONS

This application claims priority under 35 U.S.C. §371 to and is the National Stage of International Application No. PCT/US2012/041970 entitled, "Shunt Tube Connection Assembly and Method", filed on Jun. 11, 2012, by Gregory Scott Cunningham, et al., which is incorporated herein by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the course of completing an oil and/or gas well, a string of protective casing can be run into the wellbore followed by production tubing inside the casing. The casing can be perforated across one or more production zones to allow production fluids to enter the casing bore. During production of the formation fluid, formation sand may be swept into the flow path. The formation sand tends to be relatively fine sand that can erode production components in the flow path. In some completions, the wellbore is uncased, and an open face is established across the oil or gas bearing zone. Such open bore hole (uncased) arrangements are typically utilized, for example, in water wells, test wells, and horizontal well completions.

When formation sand is expected to be encountered, one or more sand screens can be installed in the flow path between the production tubing and the perforated casing (cased) and/or the open well bore face (uncased). A packer is customarily set above the sand screen to seal off the annulus in the zone where production fluids flow into the production tubing. The annulus around the screen can then be packed with a relatively coarse sand (or gravel) which acts as a filter to reduce the amount of fine formation sand reaching the screen. The packing sand is pumped down the work string in a slurry of water and/or gel and fills the annulus between the sand screen and the well casing. In well installations in which the screen is suspended in an uncased open bore, the sand or gravel pack may serve to support the surrounding unconsolidated formation.

During the sand packing process, annular sand "bridges" can form around the sand screen that may prevent the complete circumscribing of the screen structure with packing sand in the completed well. This incomplete screen structure coverage by the packing sand may leave an axial portion of the sand screen exposed to the fine formation sand, thereby undesirably lowering the overall filtering efficiency of the sand screen structure.

One conventional approach to overcoming this packing sand bridging problem has been to provide each generally tubular filter section with a series of shunt tubes that longitudinally extend through the filter section, with opposite ends of each shunt tube projecting outwardly beyond the active filter portion of the filter section. In the assembled sand screen structure, the shunt tube series are axially joined to one another to form a shunt path extending along the length of the sand screen structure. The shunt path operates to permit the inflowing packing sand/gel slurry to bypass any sand bridges that may be formed and permit the slurry to enter the screen/casing annulus beneath a sand bridge, thereby forming the desired sand pack beneath it.

SUMMARY

In an embodiment, a shunt tube assembly comprises a shunt tube and a jumper tube comprising a first end. The shunt tube comprises a non-round cross section, and the first end of the jumper tube is coupled to the shunt tube at a coupling. The first end of the jumper tube comprises a substantially round cross section at the coupling.

In an embodiment, a shunt tube assembly comprises a shunt tube comprising a first cross-sectional shape, a jumper tube comprising a second cross-sectional shape, and a coupling member comprising a first end and a second end. The coupling member is configured to provide a sealing engagement between the coupling member and the shunt tube at the first end, and the coupling member is configured to provide a sealing engagement between the coupling member and the jumper tube at the second end.

In an embodiment, a shunt tube assembly comprises a plurality of shunt tubes, a jumper tube, and a coupling member configured to provide fluid communication between the jumper tube and the plurality of shunt tubes.

In an embodiment, a coupling member for use with a shunt tube assembly comprises a body member comprising a first side and a second side, a first opening disposed through the first side, and a second opening disposed through the second side. The body member is configured to be disposed about a wellbore tubular, the first opening is configured to engage a shunt tube, and the second opening is configured to engage a jumper tube. The first opening is in fluid communication with the second opening.

In an embodiment, a coupling member for use with a shunt tube assembly comprises a first body member, a second body member, and a chamber defined between the first body member and the second body member. The first body member is configured to be rotatably disposed about a wellbore tubular, and the first body member comprises a first opening configured to receive a jumper tube. The second body member is configured to be disposed about a wellbore tubular, and the second body member comprises one or more second openings configured to receive one or more shunt tubes. The first opening is in fluid communication with the one or more second openings through the chamber.

In an embodiment, a method of forming a shunt tube coupling comprises aligning a first end of a jumper tube with a shunt tube, where the shunt tube comprises a non-round cross section, and coupling the first end of the jumper tube to the shunt tube at a coupling, where the first end of the jumper tube comprises a substantially round cross section at the coupling.

In an embodiment, a method of gravel packing comprises passing a slurry through a first shunt tube, where the first shunt tube comprises a first cross-sectional shape, passing the slurry through a coupling, where the coupling comprises a coupling between the first shunt tube and a jumper tube, and where the jumper tube comprises a substantially round cross-section at the coupling, and disposing the slurry about a well screen assembly below the coupling.

In an embodiment, a method of forming a shunt tube coupling comprises rotating a first ring about a wellbore tubular, engaging a jumper tube with the first ring, rotating a second ring about the wellbore tubular, engaging one or more shunt tubes with the second ring, and forming a sealing engagement between the first ring and the second ring.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
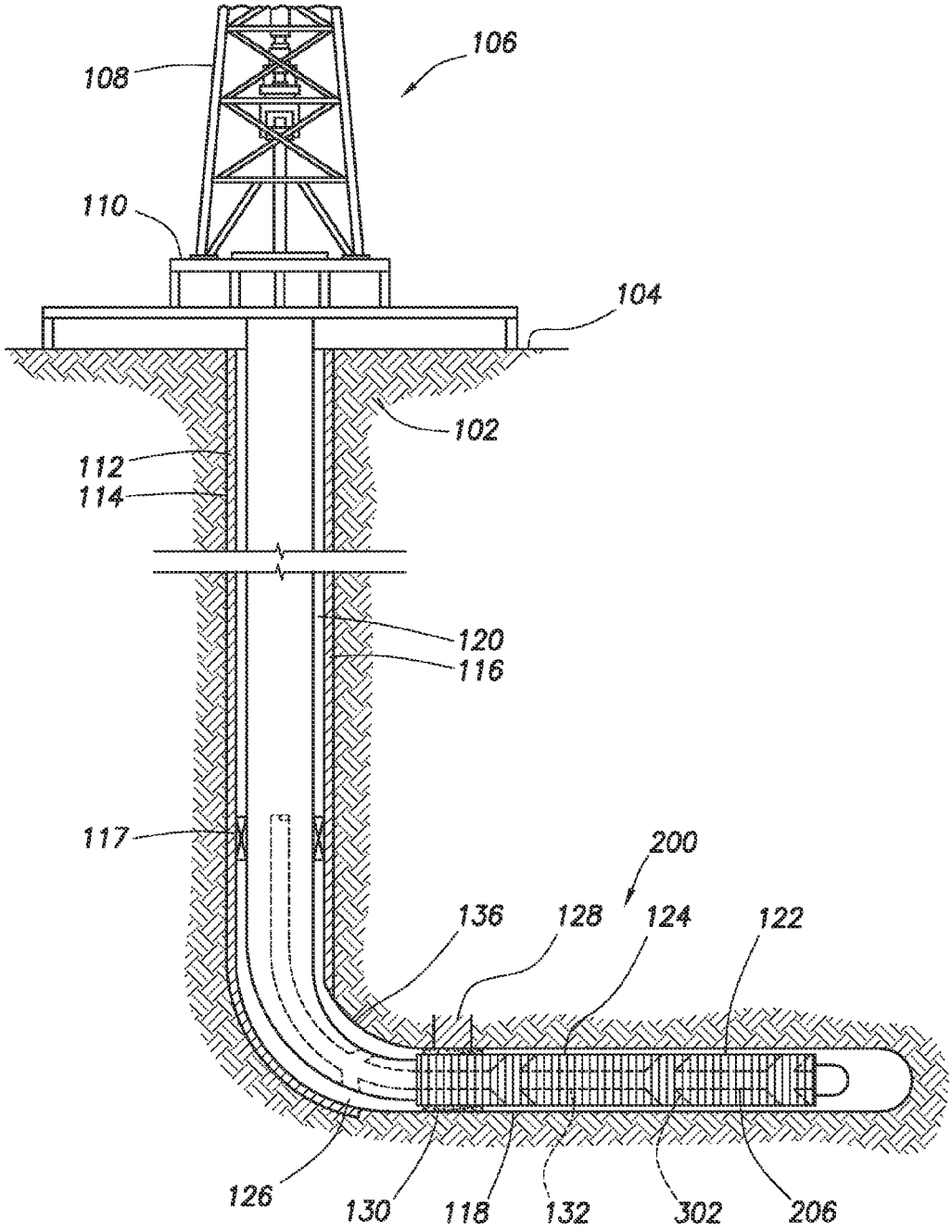
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "above" meaning toward the surface of the wellbore and with "down," "lower," "downward," "downstream," or "below" meaning toward the terminal end of the well, regardless of the wellbore orientation. Reference to inner or outer will be made for purposes of description with "in," "inner," or "inward" meaning towards the central longitudinal axis of the wellbore and/or wellbore tubular, and "out," "outer," or "outward" meaning towards the wellbore wall. As used herein, the term "longitudinal" or "longitudinally" refers to an axis substantially aligned with the central axis of the wellbore tubular, and "radial" or "radially" refer to a direction perpendicular to the longitudinal axis. The various characteristics mentioned above, as well as other features and characteristics described in more detail below, will be readily apparent to those skilled in the art with the aid of this disclosure upon reading the following detailed description of the embodiments, and by referring to the accompanying drawings.

Shunt tubes used in shunt tube systems generally have non-round cross-sectional shapes. These cross-sectional shapes allow for the shunt tubes to be arranged adjacent the wellbore tubular and provide a desired flow area without requiring an outer diameter that would otherwise be associated with the use of all round components. The jumper tubes used to couple shunt tubes on adjacent wellbore tubular joints are generally of the same non-round cross section as the shunt tubes to allow for a flow path having a continuous cross-sectional shape along the length of the shunt tube system. However, the use of couplings having non-round cross sections may lead to unreliable connections and the need to closely align the ends of the shunt tubes on adjacent joints of wellbore tubulars. Further, the use of couplings having non-round cross sections may result in a limit to the pressure rating of the coupling.

Rather than use couplings having non-round cross sections matching those of the shunt tubes, the system disclosed herein utilizes couplings having substantially round cross-sections. The use of couplings with substantially round cross-sections may allow for an improved seal at the couplings, thereby improving the pressure ratings of the couplings. These benefits may provide for more reliable couplings to be formed and improve the assembly time for forming the shunt tube system.

Referring to FIG. 1, an example of a wellbore operating environment in which a well screen assembly may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore 114 may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both producing wells and injection wells. The wellbore 114 may also be used for purposes other than hydrocarbon production such as geothermal recovery and the like.

A wellbore tubular 120 may be lowered into the subterranean formation 102 for a variety of drilling, completion, workover, treatment, and/or production processes throughout the life of the wellbore. The embodiment shown in FIG. 1 illustrates the wellbore tubular 120 in the form of a completion assembly string comprising a well screen assembly 122, which in turn comprises a shunt tube assembly, disposed in the wellbore 114. It should be understood that the wellbore tubular 120 is equally applicable to any type of wellbore tubulars being inserted into a wellbore including as non-limiting examples drill pipe, casing, liners, jointed tubing, and/or coiled tubing. Further, the wellbore tubular 120 may operate in any of the wellbore orientations (e.g., vertical, deviated, horizontal, and/or curved) and/or types described herein. In an embodiment, the wellbore may comprise wellbore casing 112, which may be cemented into place in at least a portion of the wellbore 114.

In an embodiment, the wellbore tubular 120 may comprise a completion assembly string comprising one or more downhole tools (e.g., zonal isolation devices 117, screen assemblies 122, valves, etc.). The one or more downhole tools may take various forms. For example, a zonal isolation device 117 may be used to isolate the various zones within a wellbore 114 and may include, but is not limited to, a packer (e.g., production packer, gravel pack packer, frac-pac packer, etc.). While FIG. 1 illustrates a single screen assembly 122, the wellbore tubular 120 may comprise a plurality of screen assemblies 122. The zonal isolation devices 117 may be used between various ones of the screen assemblies 122, for example, to isolate different gravel pack zones or intervals along the wellbore 114 from each other.

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for conveying the wellbore tubular 120 into the wellbore 114 to position the wellbore tubular 120 at a selected depth. While the operating environment depicted in FIG. 1 refers to a stationary workover and/or drilling rig 106 for conveying the wellbore tubular 120 within a land-based wellbore 114, in alternative embodiments, mobile workover rigs, wellbore servicing units (such as coiled tubing units), and the like may be used to convey the wellbore tubular 120 within the wellbore 114. It should be understood that a wellbore tubular 120 may alternatively be used in other operational environments, such as within an offshore wellbore operational environment.

In use, the screen assembly 122 can be positioned in the wellbore 114 as part of the wellbore tubular string adjacent a hydrocarbon bearing formation. An annulus 124 is formed between the screen assembly 122 and the wellbore 114. A gravel slurry 126 may travel through the annulus 124 between the well screen assembly 122 and the wellbore 114 wall as it is pumped down the wellbore 114 around the screen assembly 122. Upon encountering a section of the subterranean formation 102 including an area 128 of highly permeable material, the highly permeable area 128 can draw liquid from the slurry, thereby dehydrating the slurry. As the slurry dehydrates in the permeable area 128, the remaining solid particles form a sand bridge 130 and prevent further filling of the annulus 124 with gravel. One or more shunt tubes 132 may be used to create an alternative path for gravel around the sand bridge 130. The shunt tube 132 allows a slurry of sand to enter an apparatus and travel in the shunt tube 132 past the sand bridge 130 to reenter the annulus 124 downstream. The shunt tube 132 may be placed on the outside of the wellbore tubular 120 or run along the interior thereof.

The screen assembly 122 comprises one or more interconnected joints of threaded wellbore tubulars having shunt tube assemblies disposed about each joint of the wellbore tubulars. Adjacent sections may generally be substantially longitudinally aligned to allow the ends of adjacent shunt tubes on adjacent sections to be coupled with jumper tubes. The present disclosure teaches the use of various jumper tube and coupling mechanism configurations to improve the coupling between the various shunt tubes on adjacent sections. In an embodiment, the shunt tube and the jumper tube may comprise substantially round (e.g., circular) ends, thereby allowing for a coupling between the two components comprising a substantially round cross-section. In an embodiment, a coupling member may be used to couple to a shunt tube having an end with a non-round (e.g., non-circular) cross-section and a jumper tube having an end with a substantially round cross-section. The coupling member may be configured to provide fluid communication between a jumper tube and one or more shunt tubes, for example, a transport tube and a packing tube. In an embodiment, the jumper tube may comprise a non-uniform cross-sectional shape along its length. For example, one or more of the ends of the jumper tube may have a substantially round cross-section, and one or more portions between the ends of the jumper tube may have non-round cross-sections. Such an embodiment may be useful in reducing the outer diameter of the jumper tubes while maintaining the available flow area for fluid transport.

Figure 2:
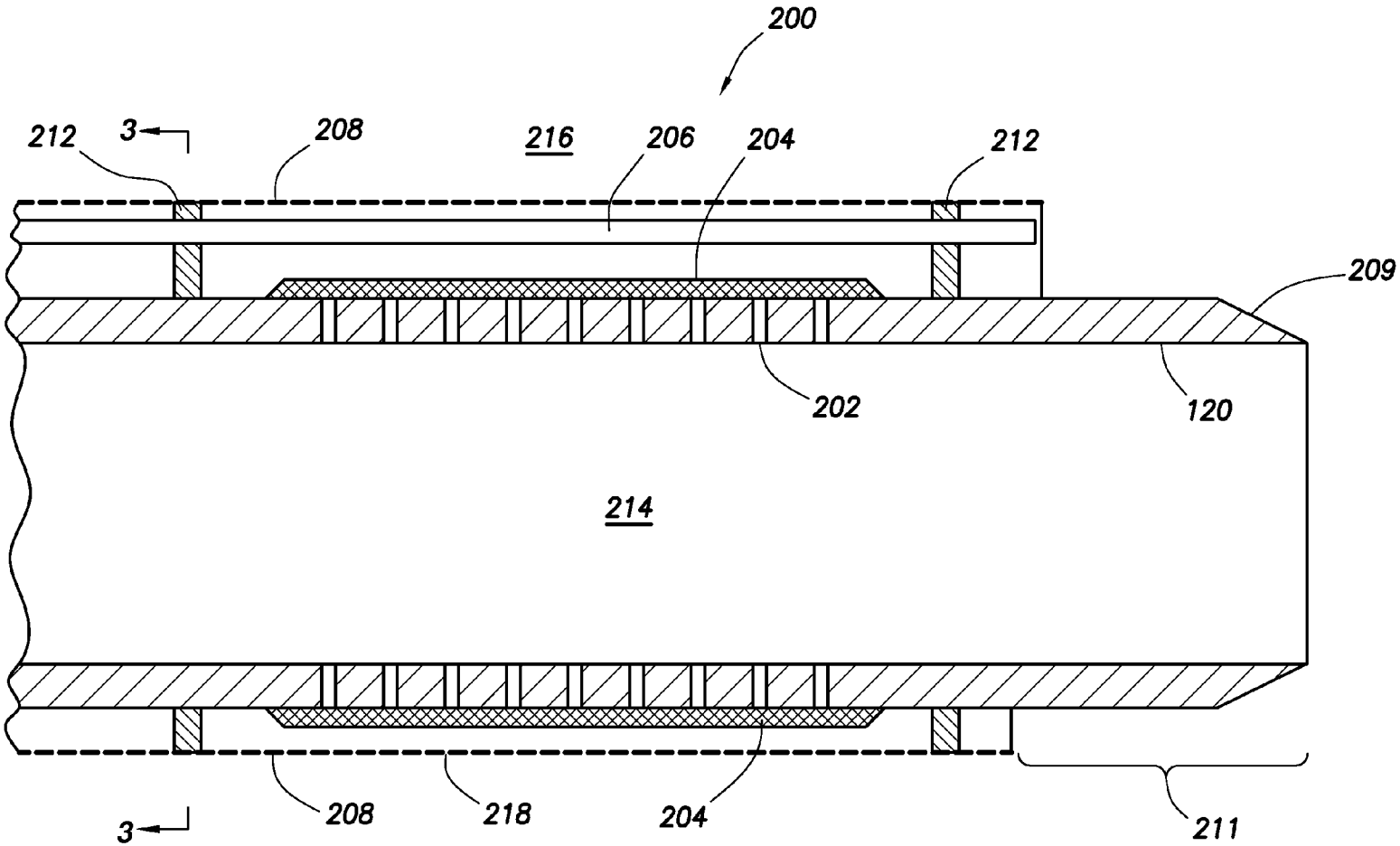
FIG. 2 is a cross-sectional view of an embodiment of a shunt tube assembly.

A cross-sectional view of an embodiment of an individual joint of wellbore tubular comprising a shunt tube assembly 200 disposed thereabout is shown in FIG. 2. The wellbore tubular 120 generally comprises a series of perforations 202 disposed therethrough. A filter media 204 is disposed about the wellbore tubular 120 and the series of perforations 202 to screen the incoming fluids from the formation. The shunt tube assembly 200 comprises one or more retaining rings 212 and one or more shunt tubes 206 disposed along and generally parallel to the wellbore tubular 120. An outer body member 208 may be disposed about the wellbore tubular 120, one or more shunt tubes 206, and filter media 204. In an embodiment, the retaining rings 212 are configured to retain the one or more shunt tubes 206 and/or outer body member 208 in position relative to the wellbore tubular 120.

The wellbore tubular 120 comprises the series of perforations 202 through the wall thereof. The wellbore tubular 120 may comprise any of those types of wellbore tubular described above with respect to FIG. 1. While the wellbore tubular 120 is illustrated as being perforated in FIG. 2, the wellbore tubular 120 may be slotted and/or include perforations of any shape so long as the perforations permit fluid communication of production fluid between an interior throughbore 214 and an exterior 216 of the shunt tube assembly 200.

The wellbore tubular 120 may generally comprise a pin end 209 and a box end to allow the wellbore tubular 120 to be coupled to other wellbore tubulars having corresponding connections. As can be seen in FIG. 2, the wellbore tubular 120 may have a coupling section that extends beyond the shunt tube assembly 200. The exposed portion 211 of the wellbore tubular 120 may be used during the coupling process to allow one or more tools to engage the exposed portion 211 and thread the joint to an adjacent joint of wellbore tubular. In an embodiment, the exposed portion may be about 1 to about 5 feet, or alternatively about 2 feet to about 4 feet, though any distance suitable for allowing the wellbore tubular 120 to be coupled to an adjacent joint of wellbore tubular may be used.

The filter media 204 may be disposed about the wellbore tubular 120 and can serve to limit and/or prevent the entry of sand, formation fines, and/or other particulate matter into the wellbore tubular 120. In an embodiment, the filter media 204 is of the type known as "wire-wrapped," since it is made up of a wire closely wrapped helically about a wellbore tubular 120, with a spacing between the wire wraps being chosen to allow fluid flow through the filter media 204 while keeping particulates that are greater than a selected size from passing between the wire wraps. While a particular type of filter media 204 is used in describing the present invention, it should be understood that the generic term "filter media" as used herein is intended to include and cover all types of similar structures which are commonly used in gravel pack well completions which permit the flow of fluids through the filter or screen while limiting and/or blocking the flow of particulates (e.g. other commercially-available screens, slotted or perforated liners or pipes; sintered-metal screens; sintered-sized, mesh screens; screened pipes; prepacked screens and/or liners; or combinations thereof).

Figure 3:
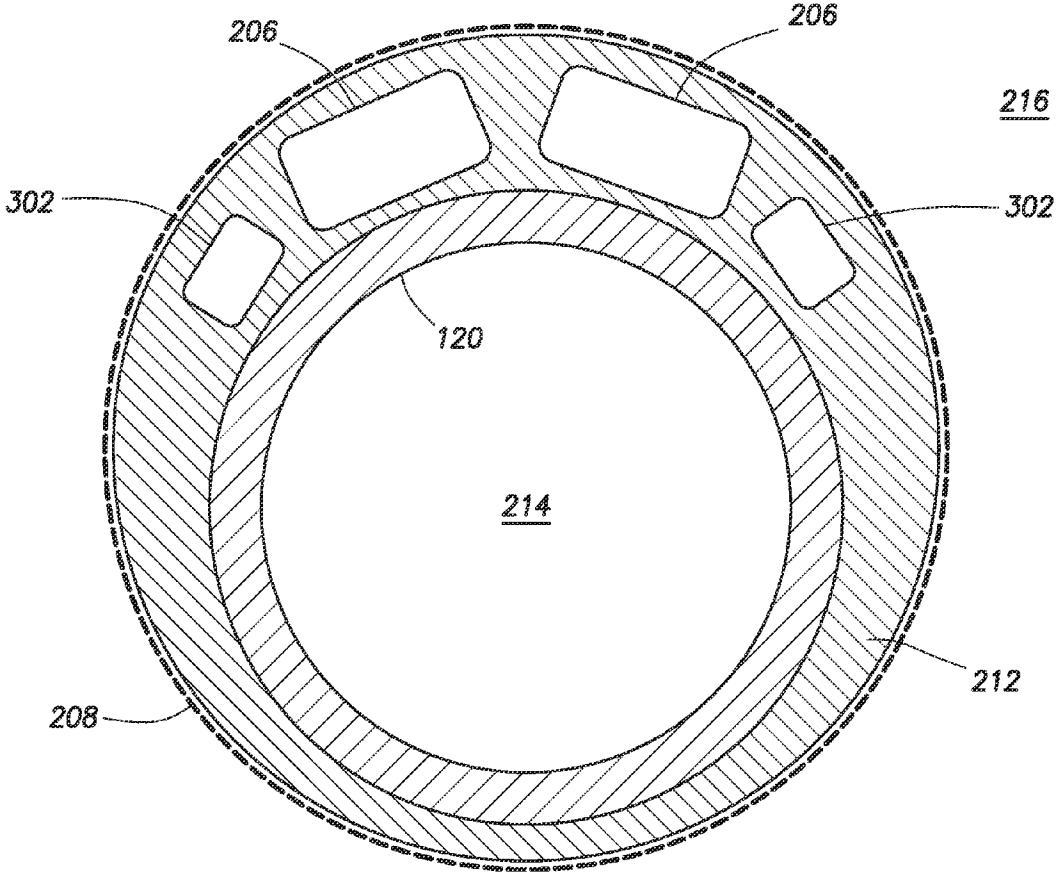
FIG. 3 is a cross-sectional view of an embodiment of a shunt tube assembly along line 3-3 of FIG. 2.

The one or more shunt tubes 206 generally comprise tubular members disposed outside of and generally parallel to the wellbore tubular 120, though other positions and alignment may be possible. While described as tubular members (e.g., having substantially circular cross-sections), the one or more shunt tubes 206 may have shapes other than cylindrical and may generally be rectangular, elliptical, kidney shaped, and/or trapezoidal in cross-section. The retaining rings 212 may retain the shunt tubes 206 in position relative to the wellbore tubular 120. The one or more shunt tubes 206 may be eccentrically aligned with respect to the wellbore tubular 120 as best seen in FIG. 3. In this embodiment, four shunt tubes 206, 302 are arranged to one side of the wellbore tubular 120 within the outer body member 208. While illustrated in FIGS. 2 and 3 as having an eccentric alignment, other alignments of the one or more shunt tubes about the wellbore tubular 120 may also be possible.

Various configurations for providing fluid communication between the interior of the one or more shunt tubes 206 and the exterior 216 of the outer body member 208 are possible. In an embodiment, the one or more shunt tubes 206 may comprise a series of perforations (e.g., openings and/or nozzles). Upon the formation of a sand bridge, a back pressure generated by the blockage may cause the slurry carrying the sand to be diverted through the one or more shunt tubes 206 until bypassing the sand bridge. The slurry may then pass out of the one or more shunt tubes 206 through the perforations in both the shunt tubes 206 and outer body member 208 and into the annular space between the wellbore tubular and casing/wellbore wall to form a gravel pack.

In an embodiment, the shunt tubes 206 may comprise transport tubes and/or packing tubes 302. The one or more packing tubes 302 may be disposed in fluid communication with the one or more transport tubes. As illustrated in FIGS. 1 and 3, the packing tubes 302 may generally comprise tubular members disposed outside of and generally parallel to the wellbore tubular 120. The transport tubes and packing tubes 302 may be disposed generally parallel to the wellbore tubular 120 and may be retained in position relative to the wellbore tubular 120 by the retaining rings 212. A first end of the packing tubes 302 may be coupled to the one or more transport tubes at various points along the length of the transport tubes, and the packing tubes may comprise a series of perforations providing fluid communication within and/or through the outer body member 208 at a second end. As shown schematically in FIG. 1, the shunt tubes may form a branched structure along the length of a screen assembly 122 with the one or more transport tubes forming the trunk line and the one or more packing tubes 302 forming the branch lines. In an embodiment, a plurality of branched structures may extend along the length of the screen assembly 122. The use of a plurality of branched structures may provide redundancy to the shunt tubes system in the event that one of the branched structures is damaged, clogged, or otherwise prevented from operating as intended.

In use, the branched configuration of the transport tubes and packing tubes 302 may provide the fluid pathway for a slurry to be diverted around a sand bridge. Upon the formation of a sand bridge, a back pressure generated by the blockage may cause the slurry carrying the sand to be diverted through the one or more transport tubes 206 until bypassing the sand bridge. The slurry may then pass out of the one or more transport tubes 206 into the one or more packing tubes 302. While flowing through the one or more packing tubes 302, the slurry may pass through the perforations in the packing tubes 302 and into the annular space about the wellbore tubular 120 to form a gravel pack.

To protect the shunt tubes 206 and/or filter media 204 from damage during installation of the screen assembly comprising the shunt tube assembly 200 within the wellbore, the outer body member 208 may be positioned about a portion of the shunt tube assembly 200. The outer body member 208 comprises a generally cylindrical member formed from a suitable material (e.g. steel) that can be secured at one or more points, for example to the retaining rings 212, which in turn, are secured to wellbore tubular 120. The outer body member 208 may have a plurality of openings 218 (only one of which is numbered in FIG. 2) through the wall thereof to provide an exit for fluid (e.g., gravel slurry) to pass through the outer body member 208 as it flows out of one or more openings in the shunt tubes 206 (e.g., through openings in the packing tubes 302), and/or an entrance for fluids into the outer body member 208 and through the permeable section of the filter media 204 during production. By positioning the outer body member 208 over the shunt tube assembly 200, the shunt tubes 206 and/or filter media 204 may be protected from any accidental impacts during the assembly and installation of the screen assembly in the wellbore that might otherwise damage or destroy one or more components of the screen assembly or the shunt tube assembly 200.

As illustrated in FIGS. 2 and 3, the shunt tubes 206, outer body member 208, and/or in some embodiments, the filter media 204 can be retained in position relative to the wellbore tubular 120 using the retaining rings 212. The retaining rings 212 generally comprise rings and/or clamps configured to engage and be disposed about the wellbore tubular 120. The retaining ring 212 may engage the wellbore tubular using any suitable coupling including, but not limited to, corresponding surface features, adhesives, curable components, spot welds, any other suitable retaining mechanisms, and any combination thereof. For example, the inner surface of the retaining ring 212 may comprise corrugations, castellations, scallops, and/or other surface features, which in an embodiment, may be aligned generally parallel to the longitudinal axis of the wellbore tubular 120. The corresponding outer surface of the wellbore tubular 120 may comprise corresponding surface features that, when engaged, couples the retaining rings 212 to the wellbore tubular 120.

FIG. 3 illustrates a cross-sectional view along line 3-3 of FIG. 2 that shows the cross-section of a retaining ring 212. In the embodiment shown in FIG. 3, the retaining ring extends around the wellbore tubular 120. A plurality of through passages are provided in the retaining ring 212 to allow the one or more shunt tubes 206, 302 to pass through a portion of the retaining ring 212. The retaining ring 212 may also be configured to engage and retain the outer body member 208 in position about the wellbore tubular 120. The retaining ring 212 may also be used to couple the shunt tubes 206, 302 to the jumper tubes, as described in more detail herein.

While the joints of wellbore tubular described herein are generally described as comprising a series of perforations 202 and filter media 204, one or more joints of wellbore tubular 120 may only have the shunt tube assemblies disposed thereabout. Such a configuration may be used between joints of wellbore tubular 120 comprising production sections to act as spacers or blank sections while still allowing for a continuous fluid path through the shunt tubes 206 along the length of the interval being completed.

In an embodiment, an assembled sand screen structure can be made up of several joints of the wellbore tubular comprising the shunt tube assemblies 200 described herein. During the formation of the assembled sand screen structure, the shunt tubes 206 on the respective joints are fluidly connected to each other as the joints are coupled together to provide a continuous flowpath for the gravel slurry along the entire length of assembled sand screen structure during gravel packing operations.

Figure 4:
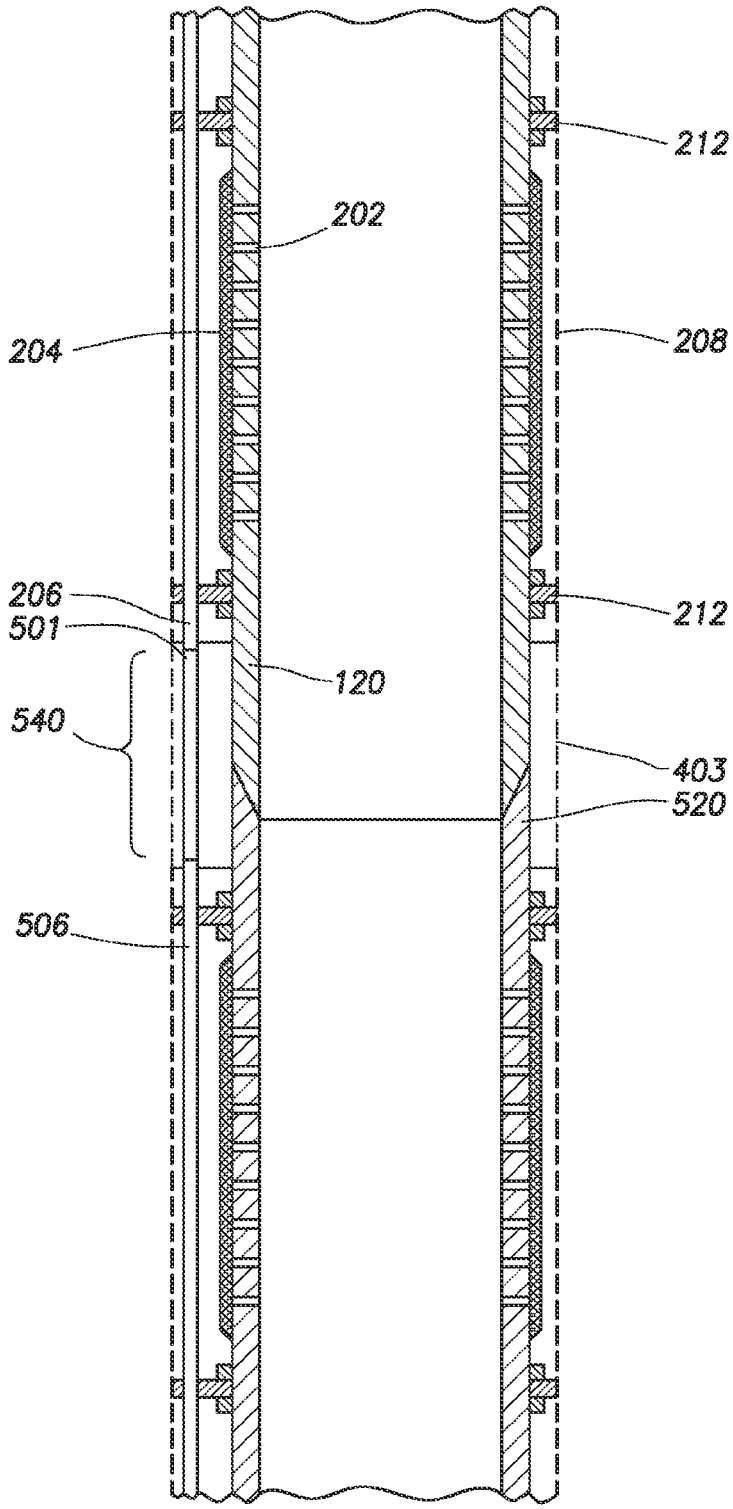
FIG. 4 is a partial cross-sectional view of an embodiment of a shunt tube assembly.

In order to couple joints of wellbore tubulars, adjacent joints comprising screens may be connected by threading together adjacent joints using a threaded coupling (e.g., using timed threads) to substantially align the shunt tubes on the adjacent joints. As illustrated in FIG. 4, the end of each shunt tube on the adjacent joints may then be individually coupled using a connector such as a jumper tube. A jumper tube may comprise a relatively short length of tubing which may be engaged to one or more shunt tubes on adjacent joints of wellbore tubulars to provide fluid communication along the length of the shunt tube system. The jumper tubes may comprise one or more tubular components that may be fixed in length or configured to provide a telescoping and extending tubular for engaging one or more shunt tubes. The various components of the jumper tube and jumper tubes connections may be configured to reduce and/or minimize the transitional flow affects through the connections, thus reducing and/or minimizing the associated pressure drops across the various components.

Typically, the jumper tube may be assembled onto the aligned shunt tubes after the adjacent joints of wellbore tubular are coupled together. In general, jumper tubes may comprise the same or similar shape to the shunt tubes to which they are coupled. However, the use of couplings with non-round cross-sectional shapes may result in a number of difficulties in forming a reliable seal. For example, the alignment of a shunt tube with a non-round cross-section and a jumper tube with a corresponding non-round cross-section may need to be more precise than the alignment of the same or similar coupling with both parts having round cross-sectional shapes. In order to address this type of issue, the connection between a shunt tube and a jumper tube may comprise a coupling with a substantially round cross-section. The use of a coupling with a substantially round cross-section may allow for more reliable seals and/or seal back-ups to be used, potentially increasing the pressure rating of the resulting coupling.

Various configurations may be used to form a coupling between a shunt tube and a jumper tube comprising a round cross-section. In an embodiment, an end of the shunt tube and jumper tube may have substantially round cross-sections, allowing the shunt tube and jumper tube to form a coupling with a substantially round cross-section. In an embodiment, a coupling member, which may be separate from the shunt tube and jumper tube, may be used to coupling the shunt tube to the jumper tube. The coupling member may comprise a first end and a second end. The coupling member may be configured to provide a sealing engagement between an end of the shunt tube, which may have a non-round cross-section, and an end of the jumper tube, which may have a round cross-section. In this embodiment, the coupling member may be configured to adapt the non-round cross-section of the shunt tube to a round cross-sectional shape for engaging the jumper tube. In an embodiment, a coupling member may be configured to engage the jumper tube with a round cross-section and a plurality of shunt tubes, which may comprise non-round cross-sections. In this embodiment, the coupling member may serve to distribute flow to a plurality of shunt tubes such as a transport tube and a packing tube. In some embodiments, the coupling member may be the retaining ring 212, where the retaining ring is configured to provide the functions of the coupling member. In an embodiment, the coupling member may comprise a plurality of body portions that are rotatable about the wellbore tubular. This may allow each portion to be rotated and engaged with the jumper tube and/or the shunt tube(s). This may allow for a longitudinal misalignment of the shunt tubes on adjacent sections of wellbore tubular. Each of these configurations will be discussed below in more detail.

Figure 5:
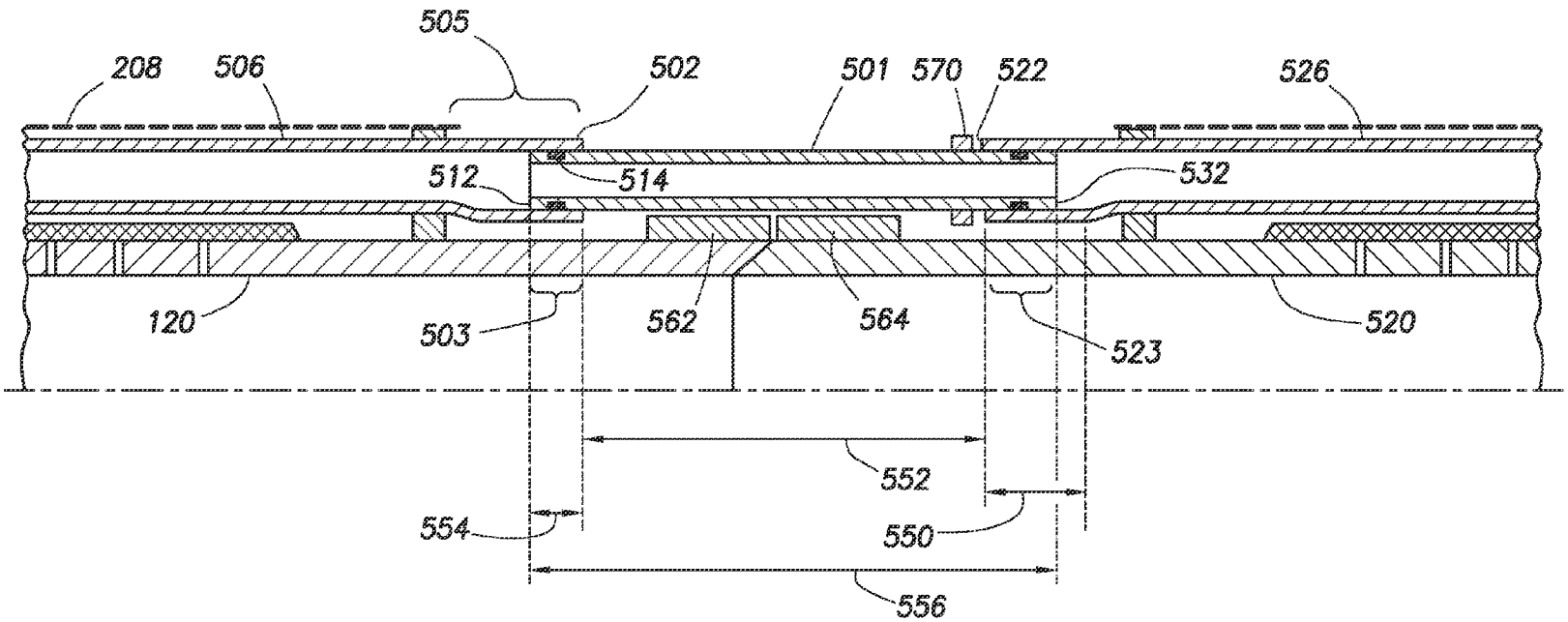
FIG. 5 is another partial cross-sectional view of an embodiment of a shunt tube assembly.

In an embodiment illustrated in FIG. 5, the shunt tube 506 may transition from a non-round cross-section to a substantially round cross-section at the coupling 503 with the jumper tube 501. As described herein, the shunt tube 506 may generally comprise a tubular member aligned along the longitudinal axis of the wellbore tubular 120. The shunt tube 506 may have a non-round cross-section along the length of the wellbore tubular joint 120. In an embodiment, a first end 502 of the shunt tube 506 may comprise a substantially round cross-section. The cross-section of the shunt tube 506 may transition from a non-round shape to a substantially round shape over a portion 505 of the shunt tube 506. Various processes may be used to form a shunt tube 506 comprising a non-round cross-section that transitions or otherwise changes to a round cross-section at the first end 502. For example, the shunt tube 506 may be rolled, cast, or otherwise formed into a tubular member comprising the different cross-sectional shapes along its length.

In an embodiment, a second shunt tube 526 may transition from a non-round cross-section to a substantially round cross-section at a second coupling 523 between the jumper tube 501 and the second shunt tube 526. The second shunt tube 526 may have a non-round cross-section along the length of a second wellbore tubular joint 520. In an embodiment, a first end 522 of the second shunt tube 526 may comprise a substantially round cross-section. The cross-section of the second shunt tube 526 may transition from a non-round shape to a substantially round shape over a portion 525 of the second shunt tube 526. Various processes may be used to form the second shunt tube 526 comprising a non-round cross-section that transitions or otherwise changes to a round cross-section at the first end 522. For example, the shunt tube 526 may be rolled, cast, or otherwise formed into a tubular member comprising the different cross-sectional shapes along its length. While it is understood that one or both ends 512, 532 of the jumper tube 501 and the corresponding ends 502, 522 of the shunt tubes 506, 526, respectively, may be formed as described herein, reference in the following discussion will be made to the first coupling 503 alone in the interest of clarity.

As noted above, the use of a round cross-section may provide for a more reliable coupling between the jumper tube 501 and a shunt tube 506. The coupling 503 between the jumper tube 501 and shunt tube 506 may also provide for a similar flow cross-sectional area as compared to the flow cross-sectional area through the shunt tube 506 upstream of the first end 502. In an embodiment, the flow cross-sectional area at the coupling between the jumper tube 501 and the shunt tube 506 may be within about 10%, within about 20%, within about 30%, within about 40%, or within about 50% of the flow cross-sectional area through the shunt tube 506 upstream of the first end 502. Due to the differing cross-sectional shapes between the shunt tubes 506 upstream of the end 502 and at the coupling between the jumper tube 501 and the shunt tube 506, the concept of a similar flow capacity may be expressed in terms of a hydraulic diameter. In an embodiment, the hydraulic diameter of the shunt tubes 506 upstream of the end 502 may be within about 10%, within about 20%, within about 30%, within about 40%, or within about 50% of the hydraulic diameter of the coupling between the jumper tube 501 and the shunt tube 506.

As can be seen in FIG. 5, the coupling 503 formed by the engagement of the jumper tube 501 with the end 502 of the shunt tube 506 may comprise the jumper tube 501 engaged within the substantially round bore of the end 502 of the shunt tube 506. One or more seals 514 (e.g., o-ring) may be disposed between the outer diameter of the jumper tube 501 and the inner diameter of the shunt tube 506 to form a sealing engagement between the jumper tube 501 and the shunt tube 506 at the coupling 503. In an embodiment, the one or more seals 514 may comprise seal back-ups for providing a higher pressure rating for the coupling 503 than if seal back-ups were not used. The one or more seals 514 may be disposed in corresponding recesses disposed on the outer diameter of the jumper tube 501 and/or in the inner diameter of the shunt tube 506. In order to aid in forming the coupling 503, the end 502 of the shunt tube 506 and/or the end 512 of the jumper tube 501 may be beveled, angled, rounded, or otherwise formed to provide a non-squared shoulder at the end of the shunt tube 506 and/or the jumper tube 501.

While FIG. 5 illustrates the end 512 of the jumper tube 501 sealingly engaged and disposed within the end 502 of the shunt tube 506, the end 512 of the jumper tube 501 may be configured to receive the end 502 of the shunt tube 506 within its bore. In this configuration, the one or more seals 514 may be disposed between the inner diameter of the jumper tube 501 and the outer diameter of the shunt tube 506 within the coupling 503. In an embodiment in which both ends of the jumper tube 501 comprise substantially round cross-sections, the engagement configuration of the jumper tube 501 and the shunt tubes 506, 526 may be the same at each end 512, 532 of the jumper tube 501. For example, the ends 512, 532 of the jumper tube 501 may be disposed within the ends 502, 522 of the shunt tubes 506, 526, respectively, or the ends 502, 522 of the shunt tubes 506, 526 may be disposed within the ends 512, 532 of the jumper tube 501. In an embodiment, the engagement configuration of the jumper tube 501 and the shunt tubes 506, 526 may be different at each end 512, 532 of the jumper tube 501. For example, the end 512 of the jumper tube 501 may be disposed within the end 502 of the shunt tube 506, and the end 522 of the shunt tube 526 may be disposed within the end 532 of the jumper tube 501, or vice-versa. In some embodiments, a coupling between the jumper tube 501 and a shunt tube 506, 526 may be formed by abutting the end 502 of the shunt tube 506 to the end 512 of the jumper tube 501. The ends 502, 512 may be held in engagement using any suitable connection methods. For example, each component may be coupled with a connection mechanism (e.g., bolts, screws, adhesives, welds, corresponding threads, or the like).

In an embodiment as illustrated in FIG. 5, the portions 505, 525 of the shunt tubes 506, 526 over which the shunt tubes 506, 526 transitions from a non-round cross-section to a substantially round cross-section may be configured to allow for a jumper tube 501 having a substantially fixed longitudinal length to be used to couple to both shunt tubes 506, 526. In this embodiment, the jumper tube 501 may be configured to be engaged with a shunt tube 526 over a sufficient distance so that the opposite end 512 of the jumper tube 501 can be aligned and engaged with the shunt tube 506. The longitudinal length 556 of the jumper tube 501 may allow both ends 512, 532 of the jumper tube 501 to engage (e.g., sealingly engage) the shunt tubes 506, 526, respectively, on adjacent joints of wellbore tubular.

As illustrated in FIG. 5, the longitudinal length of the jumper tube 501 and the portions of the shunt tubes 506, 526 configured to engage the jumper tube 501 may be configured to allow the jumper tube 501 to engage both shunt tubes 506, 526. In an embodiment, the shunt tube 526 may have a substantially round cross-section configured to receive and/or be disposed within the jumper tube 501 over the distance 550, and the shunt tube 506 may have a substantially round cross-section configured to receive and/or be disposed within the jumper tube 501 over at least a distance 554. A distance 552 may exist between the ends 502, 522 of the shunt tubes 506, 526 on adjacent joints of wellbore tubulars 120, 520. In an embodiment, a jumper tube having a substantially fixed length may be used when the overall length 556 of the jumper tube 501 is less than the sum of the distance 552 between the ends 502, 522 of the shunt tubes 506, 526 and the distance 550. This may allow the jumper tube 501 to be inserted into the shunt tube 526 a distance 550, and then be aligned with the shunt tube 506. The jumper tube 501 may then be engaged with the shunt tube 506 a distance 554, which may be less than the distance 550 to provide for an engagement between the jumper tube 501 and the shunt tubes 506, 526.

Once engaged with the shunt tubes 506, 526, the jumper tube 501 may be held in place using a retaining mechanism 570 configured to engage the jumper tube 501 and/or one or more of the shunt tubes 506, 526 to maintain the jumper tube 501 in engagement with the shunt tubes 506, 526. In an embodiment, the retaining mechanism may comprise a snap ring configured to engage the jumper tube 501 adjacent to one or both of the shunt tubes 506, 526, thereby preventing movement of the jumper tube 501 into the shunt tubes 506, 526. In some embodiments, the retaining mechanism may engage one or more of the shunt tubes 506, 526 to prevent movement of one or more of the shunt tubes 506, 526 into the jumper tube 501 (e.g., when the jumper tube 501 is configured to receive one or more of the shunt tubes 506, 526 within its bore). In some embodiments, the retaining mechanism 570 may comprise an indicator on the jumper tube 501 or the shunt tube 506, 526 with a corresponding snap fitting assembly (e.g., a snap ring, a collet lug, etc.) on the engaging surface. In some embodiments, the engagement between the jumper tube 501 and one or more of the shunt tubes 506, 526 may comprise a friction fit, compression fit, and/or the like that may be sufficient to maintain the engagement without the need for a retaining mechanism. In some embodiments, the engagement between the jumper tube 501 and one or more of the shunt tubes 506, 526 may comprise a threaded connection. For example, the engagement between the jumper tube 501 and the shunt tube 526 may comprise a sliding, sealing engagement, and the engagement with the shunt tube 506 may then be maintained using a threaded connection, thereby maintaining the engagement with the shunt tube 526 in position through the fixed engagement at the threaded interface on the shunt tube 506.

Figure 6A:
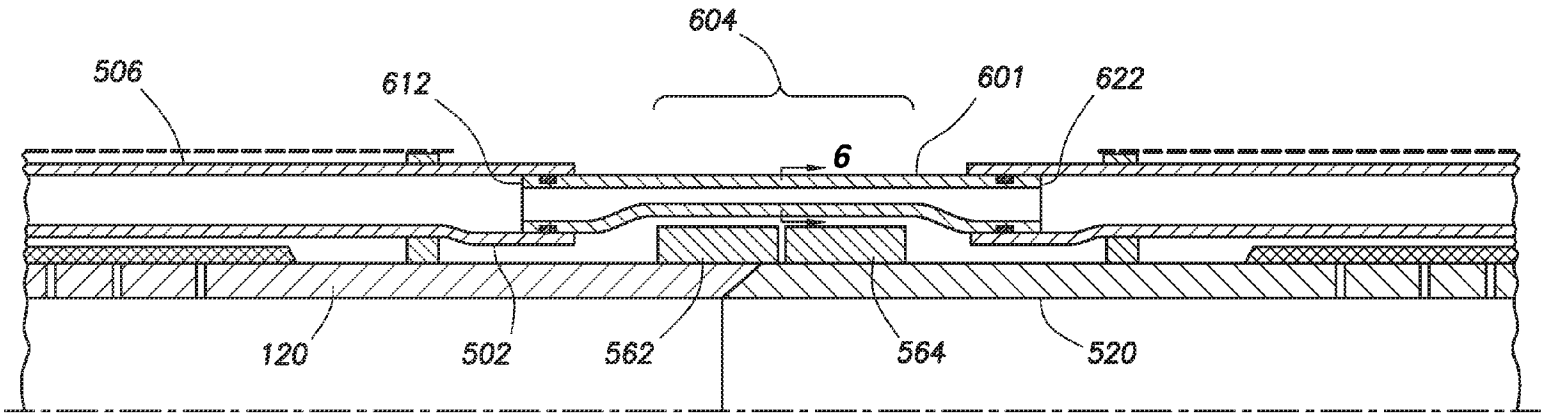
FIG. 6A is still another partial cross-sectional view of an embodiment of a shunt tube assembly.
Figure 6D:
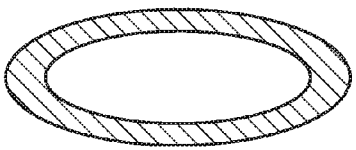
FIGS. 6B-6E are schematic cross-sectional views of an embodiment of a jumper tube.
Figure 6E:
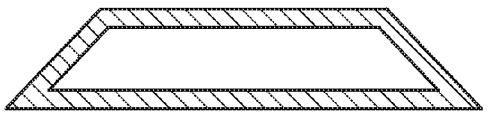
Figure 6B:
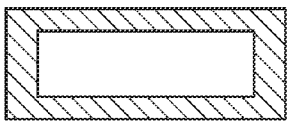
Figure 6C:
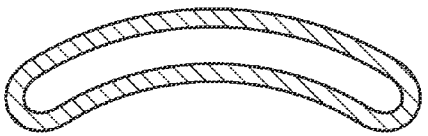

In an embodiment as illustrated in FIG. 6A, one or more portions of the jumper tube 601 may comprise a non-round cross-section. One or more protrusions 562, 564 may be disposed about the wellbore tubulars 120, 520, respectively, at the ends of the wellbore tubulars 120, 520 to provide for various mechanical properties and/or handling procedures during the coupling of the adjacent wellbore tubulars 120, 520. For example, the protrusions 562, 564 may provide engagement locations for the tongs used during the coupling process of the wellbore tubular joints 120, 520 at the surface of the well. These protrusions 562, 564 may have increased outer diameters relative to the outer diameter of the wellbore tubulars 120, 520. In some embodiments, the protrusions 562, 564 may have outer diameters that would interfere with the jumper tube 501 if the jumper tube 501 comprised a straight tubular component having a substantially round cross-section along its length. The jumper tube 501 may be sized to avoid the protrusions 562, 564, for example by reducing the diameter of the jumper tube 501, but the flow area through the jumper tube 501 may also be reduced.

In order to avoid the protrusions and/or provide additional flow area through the jumper tube 501, one or more portions of the jumper tube 501 may be configured to comprise a non-round cross-section. As shown in FIG. 6A, a portion 604 of the jumper tube 601 may have a non-round cross-section. The portion 604 of the jumper tube 601 having a non-round cross-section may be disposed adjacent to the protrusions 562, 564 forming the coupling between the wellbore tubulars 120, 520. This may allow the jumper tube to extend past the protrusions while maintaining a suitable flow area through the jumper tube 501. The non-round cross-section may comprise any suitable shape. FIGS. 6B-6E illustrate various suitable cross-sectional shapes including, but not limited to, rectangular, oval, kidney shaped (e.g., arced and/or oblong), trapezoidal, squared, and/or any other suitable non-round cross-sectional shape. In some embodiments, the jumper tube 601 may comprise a bend between the first end 612 and the second end 622 to allow the jumper tube 601 to be routed past the protrusions 562, 564 at the coupling between the wellbore tubular joints 120, 520. The bend may allow the jumper tube 601 to be disposed adjacent to the wellbore tubular 120, extend out to be disposed adjacent to the outer diameter of the protrusions 562, 564, and then be disposed adjacent to the wellbore tubular 520. This embodiment may limit the length of the portion 604 of the jumper tube 601 having an increased outer diameter.

The portion 604 of the jumper tube 601 having a non-round cross-section may have the same or similar cross-sectional area available for flow as compared to the flow cross-sectional area through the shunt tube 506 upstream of the first end 502 and/or the end 612 of the jumper tube 601. In an embodiment, the flow cross-sectional area of the portion 604 comprising the non-round cross-section may be within about 10%, within about 20%, within about 30%, within about 40%, or within about 50% of the flow cross-sectional area through the shunt tube 506 upstream of the first end 502 and/or the end 612 of the jumper tube 601. Due to the differing cross-sectional shapes between the shunt tubes 506 upstream of the end 502, the end 612 of the jumper tube 601, and/or the portion 604 comprising the non-round cross-section, the concept of a similar flow capacity may be expressed in terms of a hydraulic diameter. In an embodiment, the hydraulic diameter of the portion 604 comprising the non-round cross-section may be within about 10%, within about 20%, within about 30%, within about 40%, or within about 50% of the hydraulic diameter through the shunt tube 506 upstream of the first end 502 and/or the end 612 of the jumper tube 601.

Referring to FIGS. 4 and 5, the coupling process between the adjacent wellbore tubular joints 120, 520 may begin with coupling a first joint of wellbore tubular 120 comprising a shunt tube assembly to a second joint of wellbore tubular 520 comprising a shunt tube assembly. The wellbore tubular sections 120, 520 may generally comprise a pin and box type connection that can be threaded together and torqued according to standard connection techniques. Once coupled, the end 502 of a first shunt tube 506 on the first wellbore tubular joint 120 may be substantially aligned with the adjacent end 522 of a second shunt tube 526 on the second wellbore tubular joint 520. In an embodiment, the shunt tubes 506, 526 may be considered substantially aligned if they are aligned to within about 10 degrees, about 7 degrees, or about 5 degrees of each other.

Once the adjacent shunt tubes 506, 526 are substantially aligned, the jumper tube 501 may be used to provide a fluid coupling between the adjacent shunt tubes 506, 526. In an embodiment, the jumper tube 501 may be coupled to the adjacent ends of the adjacent shunt tubes 506, 526. For example, the jumper tube 501 may be engaged with one of the shunt tubes 506. The opposite end of the jumper tube 501 may then be extended (e.g., extended through a telescoping configuration) to engage the shunt tube 526 on the adjacent joint of wellbore tubular 520. In some embodiments, a jumper tube 501 having a fixed length may be used. In this embodiment, the jumper tube 501 may be engaged with the shunt tube 506 and displaced relative to the shunt tube 506 a sufficient distance to allow the opposite end of the jumper tube 501 to be aligned and engaged with the shunt tube 526. The jumper tube 501 may then be engaged with the shunt tube 526 a distance sufficient to form an engagement while maintaining the engagement with the first shunt tube 506. One or more seals (e.g., o-ring seals 514, etc.) may be used to provide a fluid tight connection between the jumper tube 501 and the end of the respective shunt tube 506, 526. In some embodiments, one or more retaining mechanisms may be used to maintain the engagement of the jumper tube 501 with the shunt tubes 506, 526.

Similar jumper tubes 501 may be used to couple any additional shunt tubes (e.g., transport tubes, packing tubes, etc.) being fluidly coupled between the adjacent joints of wellbore tubulars 120, 520. Having fluidly coupled the shunt tubes 506, 526 and any additional tubes on the adjacent joints of wellbore tubulars 120, 520, an additional shroud 403 may be used to protect the jumper tubes 501. In an embodiment, the shroud may be similar to the outer body member 208, and may be configured to be disposed about the jumper tube section 540 to prevent damage to the jumper tubes 501 and ends of the adjacent shunt tubes 506, 526 during conveyance within the wellbore. Once the adjacent wellbore tubulars 120, 520 are coupled and the shroud 403 has been engaged, additional joints of wellbore tubulars may be similarly coupled to the existing joints and/or additional wellbore tubulars may be used to complete the assembled sand screen structure for use in the wellbore.

Figure 7A:
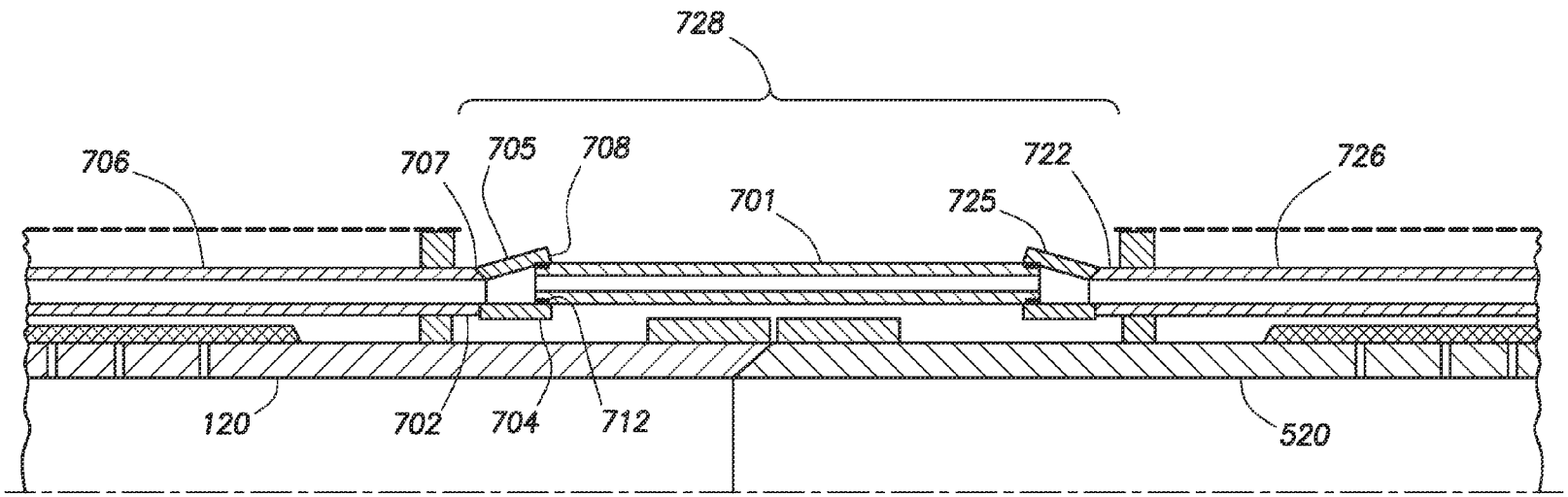
FIG. 7A is another partial cross-sectional view of an embodiment of a shunt tube assembly.
Figure 7B:
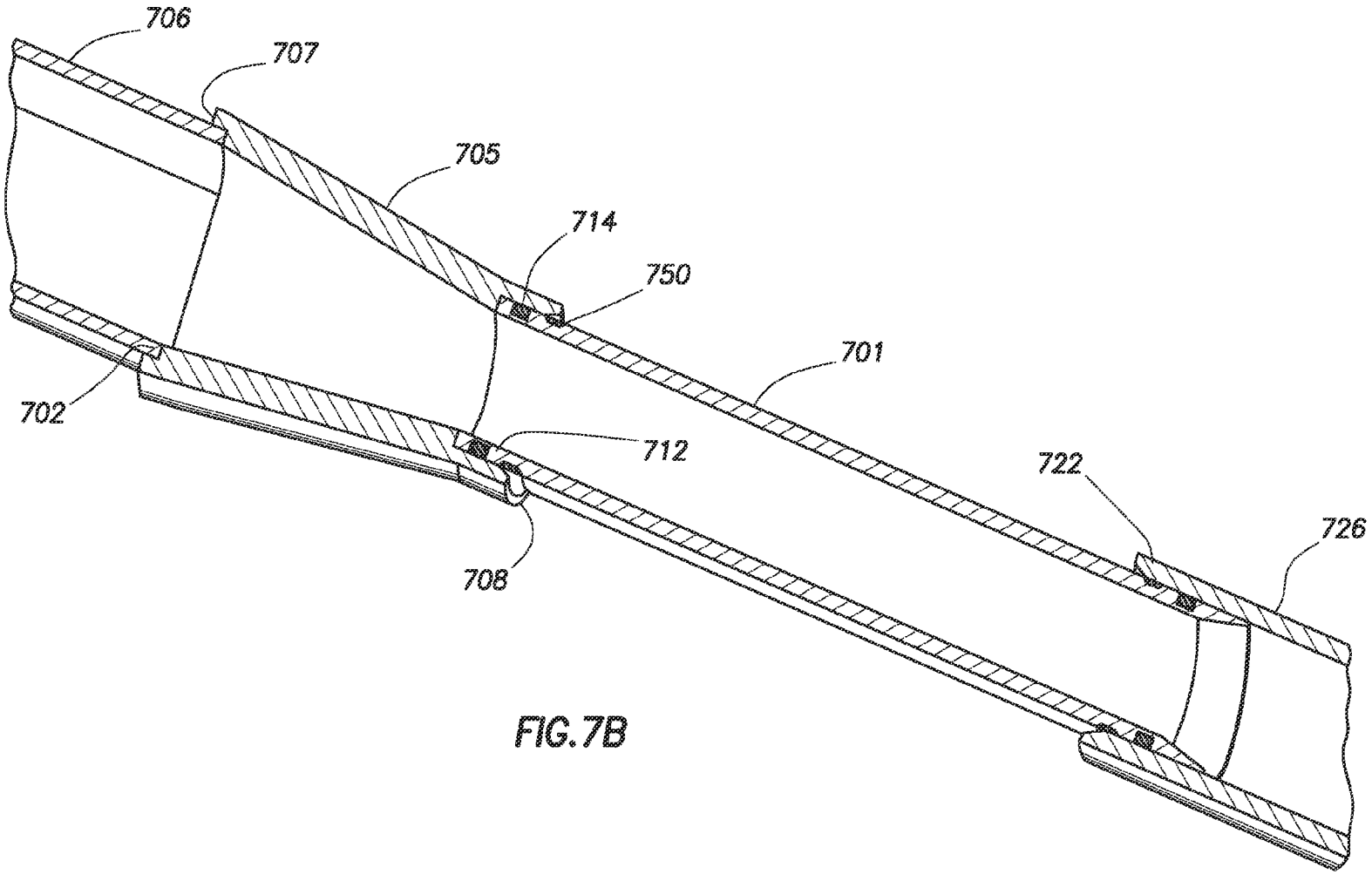
FIG. 7B is a schematic isometric view of an embodiment of a coupling member.

In an embodiment illustrated in FIGS. 7A and 7B, a coupling member 705, which may be separate from the shunt tube 706 and jumper tube 701, may be used to couple the shunt tube 706 to the jumper tube 701. The shunt tube 706 may comprise a first cross-sectional shape, which may be a non-round cross-sectional shape, and the jumper tube 701 may comprise a second cross-sectional shape, which may be a substantially round cross-sectional shape at the engagement with the coupling member 705. The coupling member 705 may then be configured to provide a sealing engagement with the shunt tube 706 and the jumper tube 701, and the coupling member 705 may act as a converter between the cross-sectional shapes of the shunt tube 706 and the jumper tube 701. In an embodiment, one or more portions of the jumper tube 701 may comprise a non-round cross-section. Any of the jumper tube 701 configurations comprising non-round cross-sections discussed with respect to FIGS. 5 and 6A-6E may be used with the jumper tube 701 coupled to the coupling member.

The coupling member 705 may generally comprise a tubular member comprising a first end 707 having a non-round cross-section and a second end 708 having a substantially round cross-section. A flowbore may be disposed through the coupling member 705 for providing fluid communication between the first end 707 and the second end 708. The coupling member 705 may be configured to provide a sealing engagement between an end 702 of the shunt tube 706, which may have a non-round cross-section, and an end 712 of the jumper tube 701, which may have a round cross-section. In this embodiment, the coupling member may be configured to adapt the non-round cross-section of the shunt tube 706 to a round cross-sectional shape for engaging the jumper tube 701. In order to adapt the cross-sections of the shunt tube 706 to the jumper tube 701, the cross-section of the flowbore and/or the outer diameter of the coupling member 705 may transition along the length of the coupling member 705. The relative inner diameter of the first end 707 and the second end 708 of the coupling member 705 may be selected to provide for the connections to the shunt tube 706 and the jumper tube 701.

As illustrated in FIG. 7B, the first end 707 of the coupling member 705 may comprise a shoulder configured to engage the end 702 of the shunt tube 706. One or more seals (e.g., O-ring seals with or without seal backups) may be disposed between the end 702 of the shunt tube 706 and the coupling member 705 to provide for a sealing engagement between the shunt tube 706 and the coupling member 705. In an embodiment, the coupling member 705 may be fixedly coupled to the shunt tube 706 using, for example, a connector (e.g., bolts, screws, and the like), adhesives, welds, or any other suitable connections.

The coupling member 705 may also form a sealing engagement with the end 712 of the jumper tube 701. One or more seals 714 (e.g., o-ring) may be disposed between the outer diameter of the jumper tube 701 and the inner diameter of the coupling member 705 to form a sealing engagement between the jumper tube 701 and the coupling member 705. In an embodiment, the one or more seals 714 may comprise seal back-ups for providing a higher pressure rating for the sealing engagement than if seal back-ups were not used. The one or more seals 714 may be disposed in corresponding recesses disposed on the outer diameter of the jumper tube 701 and/or in the inner diameter of the coupling member 705. In order to aid in forming the engagement, the end 712 of the jumper tube 701 and/or the end 708 of the coupling member 705 may comprise a beveled, angled, rounded, or otherwise formed portion to provide a non-squared shoulder 750 at the end of the jumper tube 701 and/or the coupling member 705.

Figure 8:
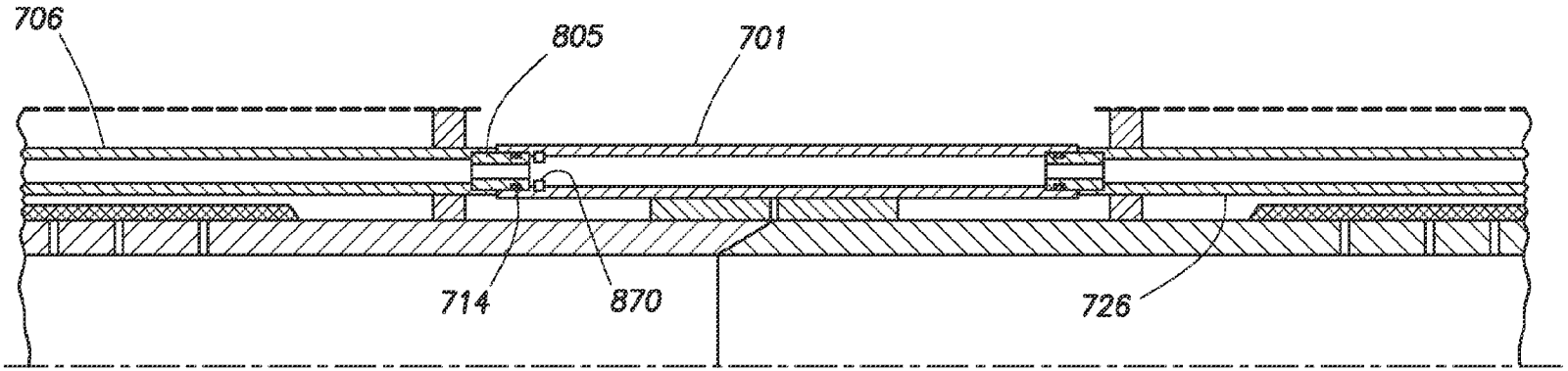
FIG. 8 is another partial cross-sectional view of an embodiment of a shunt tube assembly.

While FIGS. 7A and 7B illustrate the coupling member 705 receiving the shunt tube 706 and the jumper tube 701 within the flowbore, the coupling member 705 may also be received within the shunt tube 706 and/or the jumper tube 701. As illustrated in FIG. 8, the coupling member 805 may be received within and engage an inner diameter of the shunt tube 706 and the jumper tube 701. In this configuration, the one or more seals 714 may be disposed between the inner diameter of the shunt tube 706 and/or the jumper tube 701 and the outer diameter of the coupling member 805. It will be appreciated that the coupling member may be received within, disposed about, or abut the end of the shunt tube 706 and/or the jumper tube 701. In an embodiment, the engagement configuration of the coupling member with jumper tube 701 and/or the shunt tubes 706, 726 may be the same or different so long as the coupling member engages the shunt tube and the jumper tube. The considerations of the orientations of each component discussed above with respect to FIG. 5 may also apply to the orientations of the engagement of the coupling member with the shunt tube and/or the jumper tube.

As illustrated in FIG. 8, one or more retaining mechanisms 870 may be used to maintain the coupling member 805 in engagement within the shunt tube 706 and/or the jumper tube 701. In an embodiment, the retaining mechanisms may comprise a snap ring configured to engage an inner diameter of the jumper tube 701 adjacent to the coupling member 805, thereby preventing movement of the coupling member 805 into the jumper tube 701 and/or the shunt tube 706. In an embodiment, the retaining mechanisms 870 may comprise any of those retaining mechanisms described above with respect to FIG. 5.

In an embodiment illustrated in FIGS. 7A and 7B, a second shunt tube 726 disposed on the second joint of wellbore tubular 520 may comprise a non-round cross-section. The non-round cross-section of the shunt tube 706 may be the same as or different than the non-round cross-section of the second shunt tube 726. The non-round cross-section of the shunt tube 706 may extend into the jumper tube section 728 for coupling to the jumper tube 701 using the coupling member 705. In an embodiment, the non-round cross-section of the second shunt tube 726 may extend into the jumper tube section 702 for coupling to the jumper tube 701 using a second coupling member 725. The second coupling member 725 may be the same or similar to the coupling member 705, though the cross-sectional shape of the end having the non-round cross-sectional shape may be different than the non-round cross-sectional shape of the coupling member 705. While the coupling member 705 is discussed herein, it is understood that the description also applies to the second coupling member 725.

The coupling member 705 providing the engagement and fluid communication between the jumper tube 701 and shunt tube 706 may also provide for a similar flow cross-sectional area as compared to the flow cross-sectional area through the shunt tube 706 upstream of the first end 702. In an embodiment, the flow cross-sectional area through the coupling member 705 may be within about 10%, within about 20%, within about 30%, within about 40%, or within about 50% of the flow cross-sectional area through the shunt tube 706 upstream of the first end 702. Due to the differing cross-sectional shapes along the length of the coupling member 705 to provide the coupling with the end 702 of the shunt tube 706 and at the end 712 of the jumper tube 701, the concept of a similar flow capacity may be expressed in terms of a hydraulic diameter. In an embodiment, the hydraulic diameter of the shunt tubes 706 upstream of the end 702 may be within about 10%, within about 20%, within about 30%, within about 40%, or within about 50% of the hydraulic diameter of the flow area through the end 708 of coupling member 705.

In an embodiment, the coupling member 705 may be configured to receive the jumper tube 701 over a length of the flowbore. This configuration may be configured to allow for a jumper tube 701 having a substantially fixed longitudinal length to be used to couple to the coupling member 705 and the second coupling member 725. In this embodiment, the jumper tube 701 may be configured to be engaged with at least one of the coupling members 705, 725 over a sufficient distance so that the opposite end of the jumper tube 701 can be aligned and engaged with the shunt tube. Any of the considerations and/or configurations described with respect to the lengths, distances, and portions of the shunt tubes configured to receive the jumper tube in FIG. 5 may also apply to one or more of the coupling members 705, 725.

Figure 9:
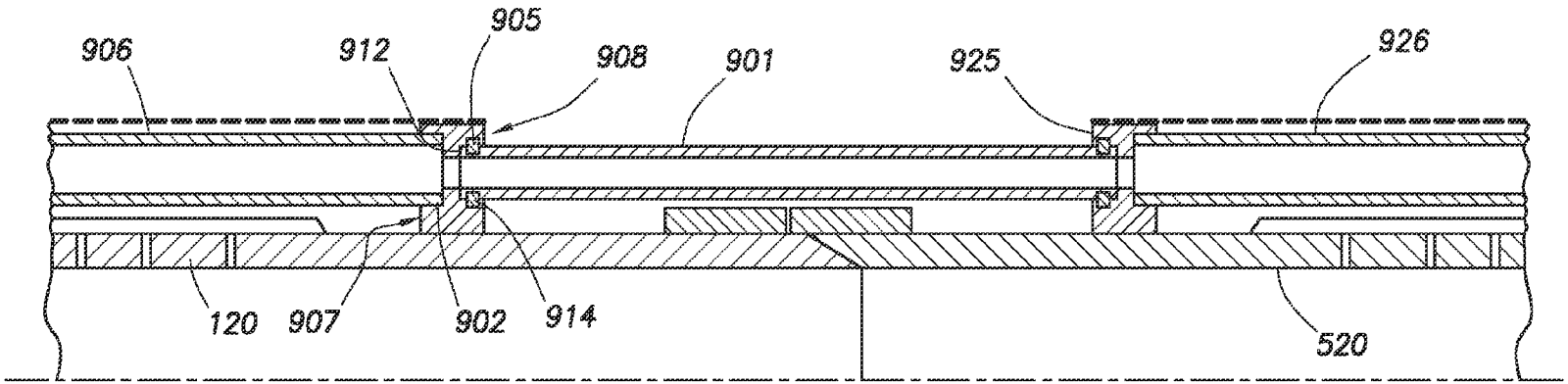
FIG. 9 is yet another partial cross-sectional view of an embodiment of a shunt tube assembly.

In an embodiment illustrated in FIG. 9, the coupling member comprises the retaining ring 905 disposed about the wellbore tubular 120. The retaining ring 905 may be used to couple the shunt tube 906 to the jumper tube 901. The shunt tube 906 may comprise a first cross-sectional shape, which may be a non-round cross-sectional shape, and the jumper tube 901 may comprise a second cross-sectional shape, which may be a substantially round cross-sectional shape at the engagement with the retaining ring 905. The retaining ring 905 may then be configured to provide a sealing engagement with the shunt tube 906 and the jumper tube 901, and the retaining ring 905 may act as a converter between the cross-sectional shapes of the shunt tube 906 and the jumper tube 901. In an embodiment, one or more portions of the jumper tube 901 may comprise a non-round cross-section. Any of the jumper tube 901 configurations comprising non-round cross-sections discussed with respect to FIGS. 5 and 6A-6E may be used with the jumper tube 901 coupled to the retaining ring 905.

The retaining ring 905 may generally comprise a ring and/or clamp configured to engage and be disposed about the wellbore tubular 120. The retaining ring 905 may have one or more fluid passages disposed therethrough to provide fluid communication from a first side 907 to a second side 908 of the retaining ring 905. The openings of the fluid passages on the first side 907 may be configured to engage one or more shunt tubes 906 having a non-round cross-section, and the openings of the fluid passages on the second side 908 may be configured to engage one or more jumper tubes 901 having a substantially round cross-section at the coupling with the retaining ring 905. The retaining ring 905 may be configured to provide a sealing engagement (e.g., using one or more o-ring seals with or without seal backups) between an end 902 of the shunt tube 906 and the retaining ring 905, and/or the retaining ring 905 may be configured to provide a sealing engagement (e.g., using one or more o-ring seals 914 with or without seal backups) between an end 912 of the jumper tube 901 and the retaining ring 905. In this embodiment, the retaining ring and the fluid passages may be configured to adapt the non-round cross-section of the shunt tube 906 to a round cross-sectional shape for engaging the jumper tube 901. In order to adapt the cross-sections of the shunt tube 906 to the jumper tube 901, the cross-section of the fluid passages through the retaining ring 905 may transition along the length of the fluid passages through the retaining ring 905. The relative inner diameters of the first end 907 and the second side 908 of the retaining ring 905 may be selected to provide for the connections to the shunt tube 906 and the jumper tube 901. The retaining ring 905 may be coupled to the shunt tube 906 and/or the jumper tube 901 using any of the connector types and configurations described herein.

In an embodiment, a second retaining ring 925 may be similarly configured to the first retaining ring 905. In this embodiment, the second retaining ring 925 may engage the jumper tube 901 and a second shunt tube 926, which may comprise a non-round cross-section, on a second wellbore tubular 520. The non-round cross-section of the shunt tube 906 may be the same as or different than the non-round cross-section of the second shunt tube 926. The second retaining ring 925 may be the same as or different than the retaining ring 905. While the retaining ring 905 is discussed herein, it is understood that the description also applies to the second retaining ring 925.

When the coupling member is a retaining ring, any of the flow considerations with respect to flow area and/or hydraulic diameter as described herein may also apply. Further, any of the considerations and/or configurations described with respect to the lengths, distances, and portions of the shunt tubes configured to receive the jumper tube in FIG. 5 may also apply to one or more of the retaining rings 905, 925, and the discussion of the relative distances is not repeated herein in the interest of clarity. Still further, any of the types of jumper tubes, including those comprising non-round cross-sections and/or bends, may be used in combination with the retaining rings 905, 925.

The use of a coupling member described with respect to FIGS. 7 and 8 and the retaining ring comprising one or more fluid passageways described with respect to FIG. 9 may be used in combination. For example, the retaining ring may comprise one or more fluid passageways comprising openings on the first and second sides with the same or similar cross-sectional shapes. One or more shunt tubes may be received at the first side of the retaining ring, and a separate coupling member may be engaged with the openings on the second side of the retaining ring. The coupling member may then act as the conversion between the opening in the retaining ring having a non-round cross-section and the substantially round cross-section of the jumper tube at the coupling with the coupling member.

Referring to FIGS. 4 and 7 to 9, the coupling process between the adjacent wellbore tubular joints 120, 520 may begin with coupling a first joint of wellbore tubular 120 comprising a shunt tube assembly to a second joint of wellbore tubular 520 comprising a shunt tube assembly. The wellbore tubular sections 120, 520 may generally comprise a pin and box type connection that can be threaded together and torqued according to standard connection techniques. Once coupled, the end 702 of a first shunt tube 706 on the first wellbore tubular joint 120 may be substantially aligned with the adjacent end 722 of a second shunt tube 726 on the second wellbore tubular joint 520.

Once the adjacent shunt tubes 706, 726 are substantially aligned, a coupling member 705 may be engaged with the shunt tube 706, and a second coupling member 725 may be coupled with the shunt tube 726. In some embodiments, the coupling members 705, 725 may be pre-coupled to the shunt tubes 706, 726. One or more seals (e.g., o-ring seals 714, etc.) may be used to provide a fluid tight connection between the shunt tubes 706, 726 and the respectively coupling members 705, 725. In an embodiment, the coupling member comprises the retaining ring 905 as shown in FIG. 9. In this embodiment, the retaining ring 905 may be pre-installed as part of the screen assembly, and may have one or more openings for engaging the jumper tube 901. While described below in terms of the coupling members 705, 725 being separate from the retaining rings 905, 925, the same or similar formation process may be used to couple the jumper tube 901 to the retaining rings 905, 925.

The jumper tube 701 may then be coupled to the coupling members 705, 725. For example, the jumper tube 701 may be engaged with one of the coupling member 705. The opposite end of the jumper tube 701 may then be extended (e.g., extended through a telescoping configuration) to engage the coupling member 725 on the adjacent joint of wellbore tubular 520. In some embodiments, a jumper tube 701 having a fixed length may be used. In this embodiment, the jumper tube 701 may be engaged with the coupling member 705 and displaced a sufficient distance to allow the opposite end of the jumper tube 701 to be aligned and engaged with the second coupling member 725. The jumper tube 701 may then be engaged with the coupling member 725 a distance sufficient to form an engagement while maintaining the engagement with the first coupling member 705. One or more seals (e.g., o-ring seals 714, etc.) may be used to provide a fluid tight connection between the jumper tube 701 and the coupling members 705, 725. In some embodiments, one or more retaining mechanisms may be used to maintain the engagement of the jumper tube 701 with the coupling members 705, 725.

Similar jumper tubes 701 and coupling members may be used to couple any additional shunt tubes (e.g., transport tubes, packing tubes, etc.) being fluidly coupled between the adjacent joints of wellbore tubulars 120, 520. Having fluidly coupled the shunt tubes 706, 726 and any additional tubes on the adjacent joints of wellbore tubulars 120, 520, an additional shroud 403 may be used to protect the jumper tubes 701. In an embodiment, the shroud 403 may be similar to the outer body member 208, and may be configured to be disposed about the jumper tube section 728 to prevent damage to the jumper tubes 701, coupling members 705, 725 and ends of the adjacent shunt tubes 706, 726 during conveyance within the wellbore. Once the adjacent wellbore tubulars 120, 520 are coupled and the shroud 403 has been engaged, additional joints of wellbore tubulars may be similarly coupled to the existing joints and/or additional wellbore tubulars may be used to complete the assembled sand screen structure for use in the wellbore.

As described above, the shunt tubes may form a branched structure along the length of a screen assembly with the one or more transport tubes forming the trunk line and the one or more packing tubes forming the branch lines. The coupling between the transport tubes and the packing tubes may occur along the length of the screen assembly with a packing tube being directly connected to the transport tube. As described herein a coupling member may be configured to engage the jumper tube and a plurality of shunt tubes. In this embodiment, the coupling member may be coupled to and configured to distribute flow to a plurality of shunt tubes such as a transport tube and a packing tube, thereby eliminating or reducing the need for the packing tubes to be directly coupled to the transport tubes.

Figure 10:
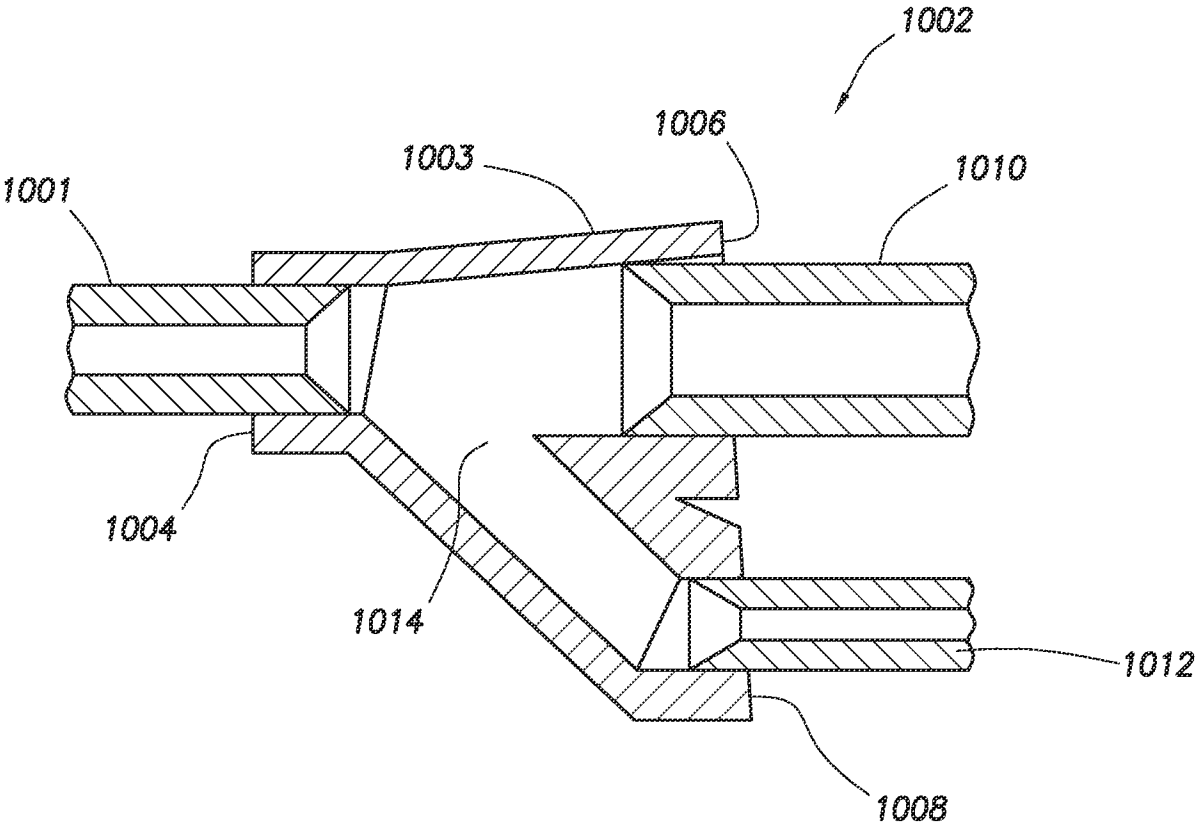
FIG. 10 is a partial cross-sectional view of an embodiment of a coupling member.

In an embodiment as illustrated in FIG. 10, the coupling member may be similar to the coupling member described with respect to FIGS. 7 and 8 and the like components will not be repeated in the interest of clarity. The coupling member 1002 may generally comprise a body portion 1003 comprising a first opening 1004 having a substantially round cross-section and a plurality of second openings 1006, 1008, which may comprise non-round cross-sections. A chamber 1014 may be disposed within the body portion 1003, and the chamber 1014 may be in fluid communication with the inlet opening 1004 and each of the plurality of outlet openings 1006, 1008. While only two second openings are depicted in FIG. 10, the body portion 1003 may comprise more than two second openings, and the chamber 1014 may be in fluid communication with each of the plurality of second openings.

In an embodiment, the first opening 1004 may be configured to receive a jumper tube 1001, and the coupling between the jumper tube 1001 and the body portion 1003 may comprise a substantially round cross-section. The plurality of second openings 1006, 1008 may comprise non-round cross-sections, and each of the second openings 1006, 1008 may be configured to engage and couple to a shunt tube 1010, 1012. In an embodiment, the second opening 1006 may be coupled to a transport tube 1010, and the second opening 1008 may be coupled to a packing tube 1012. The plurality of second openings 1006, 1008 may generally be oriented in a parallel configuration to allow for the tubular members coupled thereto to extend parallel along the length of the wellbore tubular. In an embodiment, orientations other than parallel are possible. Fluid entering the first opening through the jumper tube 1001 may be distributed to the transport tube 1010 and the packing tube 1012 through the chamber 1014.

The coupling member 1002 may be configured to provide a sealing engagement between the jumper tube 1001 and the body portion 1003. For example, one or more seals may be disposed in corresponding seal recesses between the jumper tube 1001 and the body portion 1003. In an embodiment, the seals may comprise seal back-ups to provide for suitable pressure rating through the coupling member 1002. Any of the configurations described herein with respect to the type and/or orientation of the jumper tubes, the coupling member, and/or the seal locations may also apply to the coupling member 1002.

In an embodiment, the coupling member 1002 may be configured to provide a sealing engagement between the body portion 1003 and one or more of the plurality of shunt tubes 1010, 1012. For example, one or more seals may be disposed in corresponding seal recesses between the body portion 1003 and one or more of the plurality of shunt tubes 1010, 1012. In an embodiment, the seals may comprise seal back-ups to provide for suitable pressure rating through the coupling member 1002.

Any of the configurations described herein with respect to the type and/or orientation of the jumper tubes, the coupling member, and/or the seal locations may also apply to the coupling member 1002. While described in terms of the jumper tube being coupled to a plurality of shunt tubes, the coupling member 1002 may also be used to couple a shunt tube to a plurality of jumper tubes. In this embodiment, the plurality of jumper tubes, which may comprise substantially round cross-sections at the coupling with the coupling member, may then be coupled to corresponding shunt tubes, which may comprise non-round cross-sections, on an adjacent section of wellbore tubular.

Figure 11A:
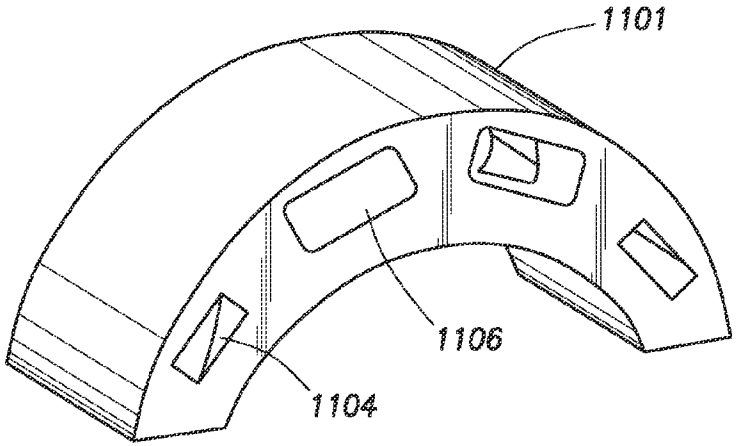
FIGS. 11A and 11B are schematic isometric views of an embodiment of a retaining ring.
Figure 11B:
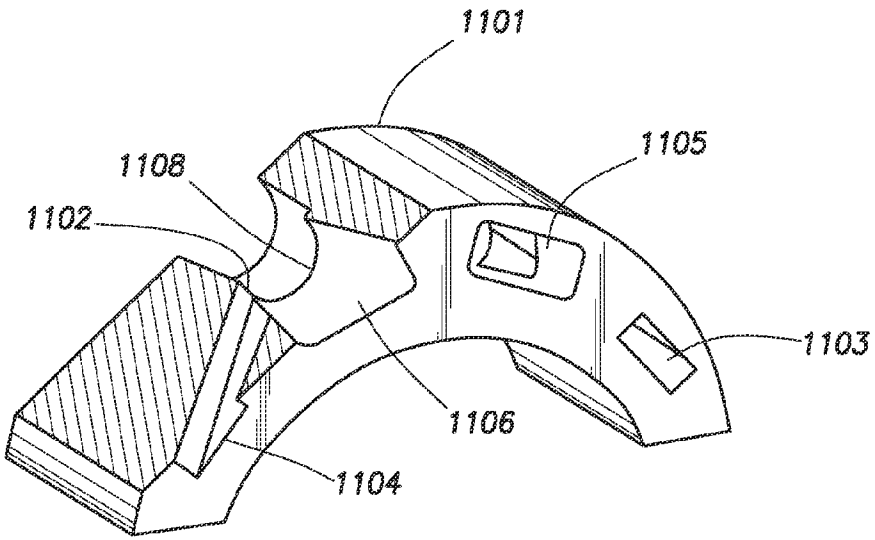
Figure 11C:
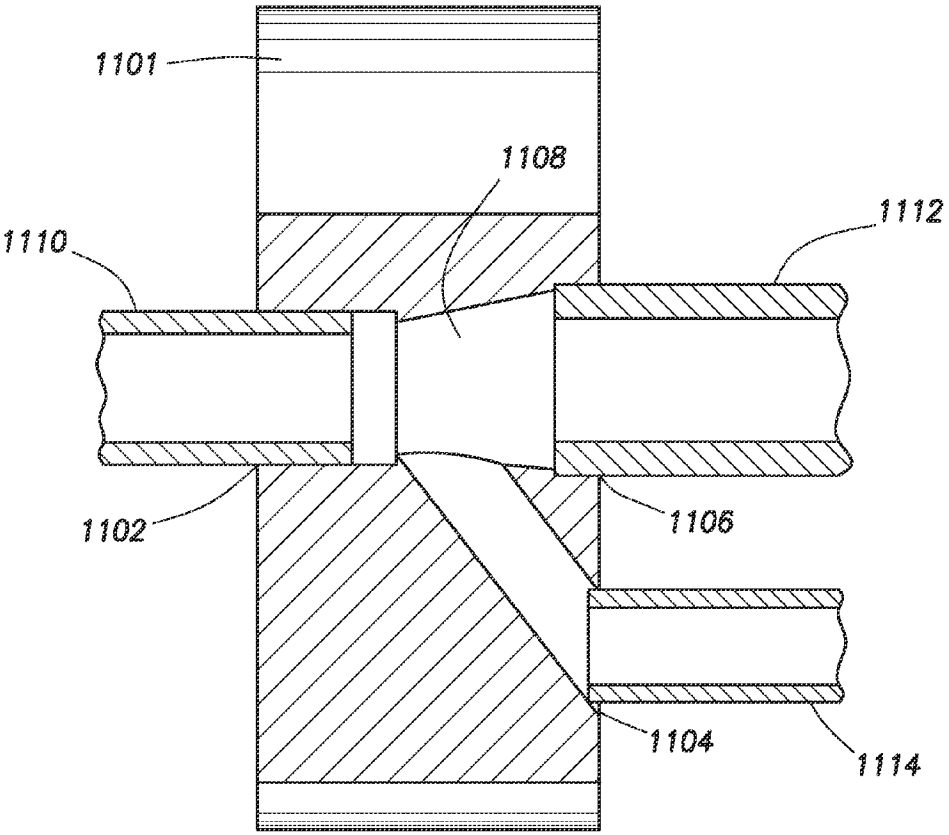
FIG. 11C is a partial cross-sectional view of an embodiment of a retaining ring.

In an embodiment illustrated in FIGS. 11A to 11C, the coupling member comprises the retaining ring 1101. While illustrated as a half-view, it is understood that the retaining ring 1101 is configured to be disposed about a wellbore tubular. The retaining ring 1101 may be used to couple a jumper tube 1110 to a plurality of shunt tubes 1112, 1114. The jumper tube 1110 may comprise a cross-sectional shape, which may be a substantially round cross-sectional shape at the engagement with the retaining ring 1101, and the plurality of shunt tubes 1112, 1114 may comprise a one or more second cross-sectional shapes, which may be non-round cross-sectional shapes. The retaining ring 1101 may then be configured to provide a sealing engagement with the jumper tube 1110 and the plurality of shunt tubes 1112, 1114, and the retaining ring 1101 may act as a converter between the cross-sectional shapes of the jumper tube 1110 and the plurality of shunt tubes 1112, 1114. In an embodiment, one or more portions of the jumper tube 1110 may comprise a non-round cross-section. Any of the jumper tube 1110 configurations comprising non-round cross-sections discussed with respect to FIGS. 5 and 6A-6E may be used with the jumper tube 1110 coupled to the retaining ring 1101.

The retaining ring 1101 may have one or more fluid passages disposed therethrough. The openings 1102 of the fluid passages on a first side may be configured to engage one or more jumper tubes 1110 having a substantially round cross-section at the coupling with the retaining ring 1101, and the openings 1104, 1106 of the fluid passages on a second side may be configured to engage one or more shunt tubes 1112, 1114 having a non-round cross-section at the coupling with the retaining ring 1101. A chamber 1108 may be disposed within the retaining ring 1101 to provide fluid communication between each of the openings 1102, 1104, 1106. The plurality of openings 1104, 1106 may generally be oriented in a parallel configuration to allow for the tubular members coupled thereto to extend parallel along the length of the wellbore tubular. In an embodiment, orientations other than parallel are possible.

The retaining ring 1101 may be configured to provide a sealing engagement (e.g., using one or more o-ring seals with or without seal backups) between one or more of the plurality of shunt tubes 1112, 1114 and the retaining ring 1101, and/or the retaining ring 1101 may be configured to provide a sealing engagement (e.g., using one or more o-ring seals with or without seal backups) between the jumper tube 1110 and the retaining ring 1101. In this embodiment, the retaining ring 1101 and the fluid passages may be configured to adapt a round cross-sectional shape for engaging the jumper tube 1110 to one or more non-round cross-sections of the shunt tubes 1112, 1114. In order to adapt the cross-sections of the plurality of shunt tubes 1112, 1114 to the jumper tube 1110, the cross-section of the fluid passages through the retaining ring 1101 may transition along the length of the fluid passages through the retaining ring 1101. The retaining ring 1101 may be coupled to the plurality of shunt tubes 1112, 1114 and/or the jumper tube 1110 using any of the connector types and configurations described herein. While illustrated as comprising two shunt tubes 1112, 1114, more than two shunt tubes may be engaged with the retaining ring 1101. Fluid entering the first opening 1102 through the jumper tube 1110 may be distributed to the transport tube 1112 and the packing tube 1114 through the chamber 1108.

The fluid communication provided by the retaining ring may be divided into two separate fluid communication pathways. As described herein, two or more separate fluid communication pathways may be used along the length of the well screen assembly to allow for redundancy in the shunt tube system. The separate fluid communication pathways may be retained by the inclusion of two openings 1102 to receive two jumper tubes 1110, and two pluralities of outlets to couple to separate pluralities of shunt tubes. For example, as shown in FIG. 11B, the fluid communication provided between the opening 1102 and the plurality of openings 1104, 1106 through the chamber 1108 may be separate from a second set of openings 1103, 1105.

Figure 12B:
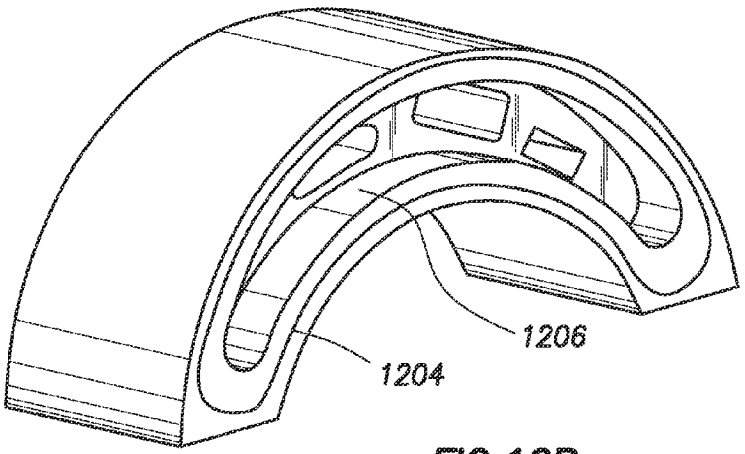
FIGS. 12A-12D are isometric views of various embodiments of a retaining ring.
Figure 12A:
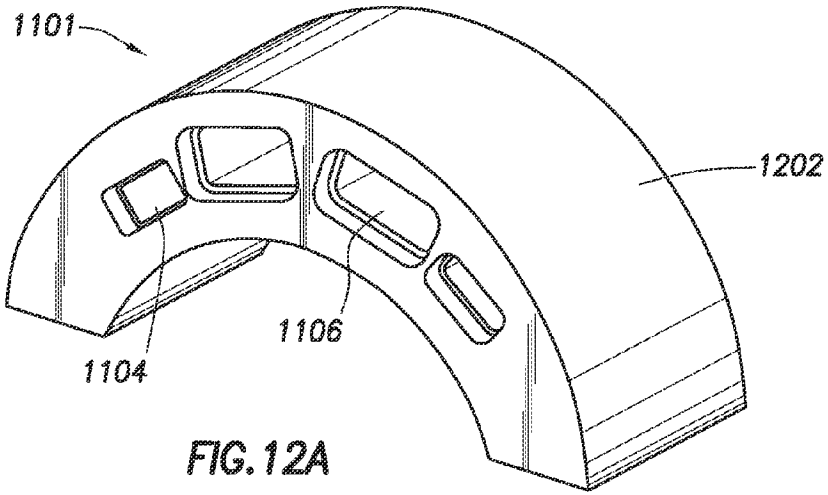

In an embodiment as illustrated in FIGS. 12A to 12D, the retaining ring 1101 may comprise a plurality of body portions. As shown in FIGS. 12A and 12B, the retaining ring 1101 may comprise a first body portion 1202 comprising the openings 1104, 1106. A seal recess 1204 may be disposed within a side of the first body portion 1202. A second body portion may be configured to engage the first body portion 1202, forming a chamber 1206 within the assembled retaining ring 1101. The second body portion may comprise the openings for receiving one or more jumper tubes. The second body portion may comprise a seal (e.g., a seal, gasket, etc.) configured to engage the seal recess 1204 and form a sealing engagement between the first body portion 1202 and the second body portion. The first body portion 1202 and second body portion may be engaged and coupled together using any suitable coupling mechanism (e.g., bolts, screws, pins, adhesives, clamps, etc.). While the retaining ring 1101 illustrated in FIGS. 12A and 12B show a single chamber 1206 being formed within the retaining ring 1101, a divider (not shown) may be disposed within the first body portion 1202 and/or the second body portion. The divider may be configured to divide the chamber 1206 into two portions, thereby maintaining independent and redundant fluid communication pathways along the length of the shunt tube assembly.

Figure 12C:
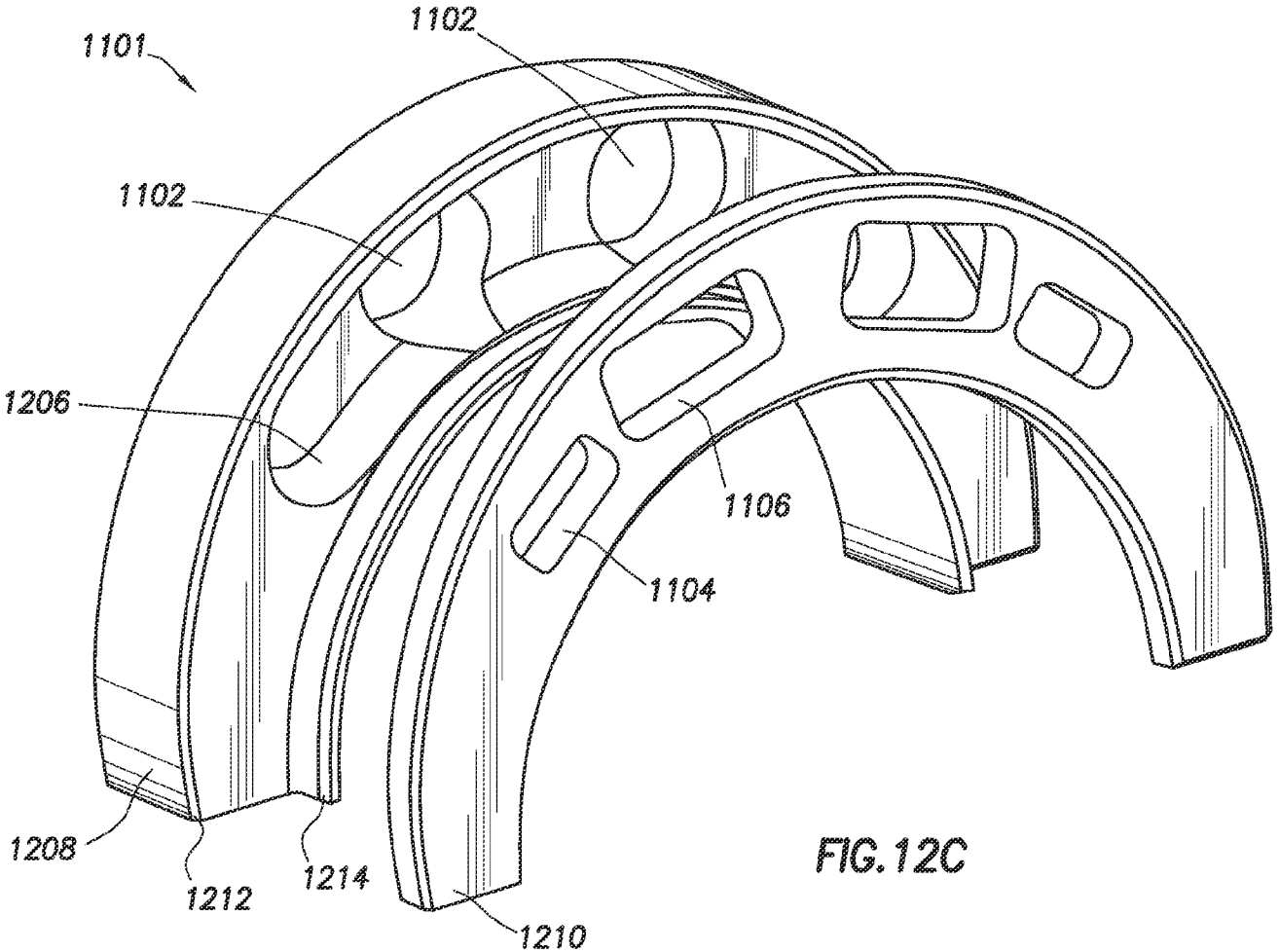
Figure 12D:
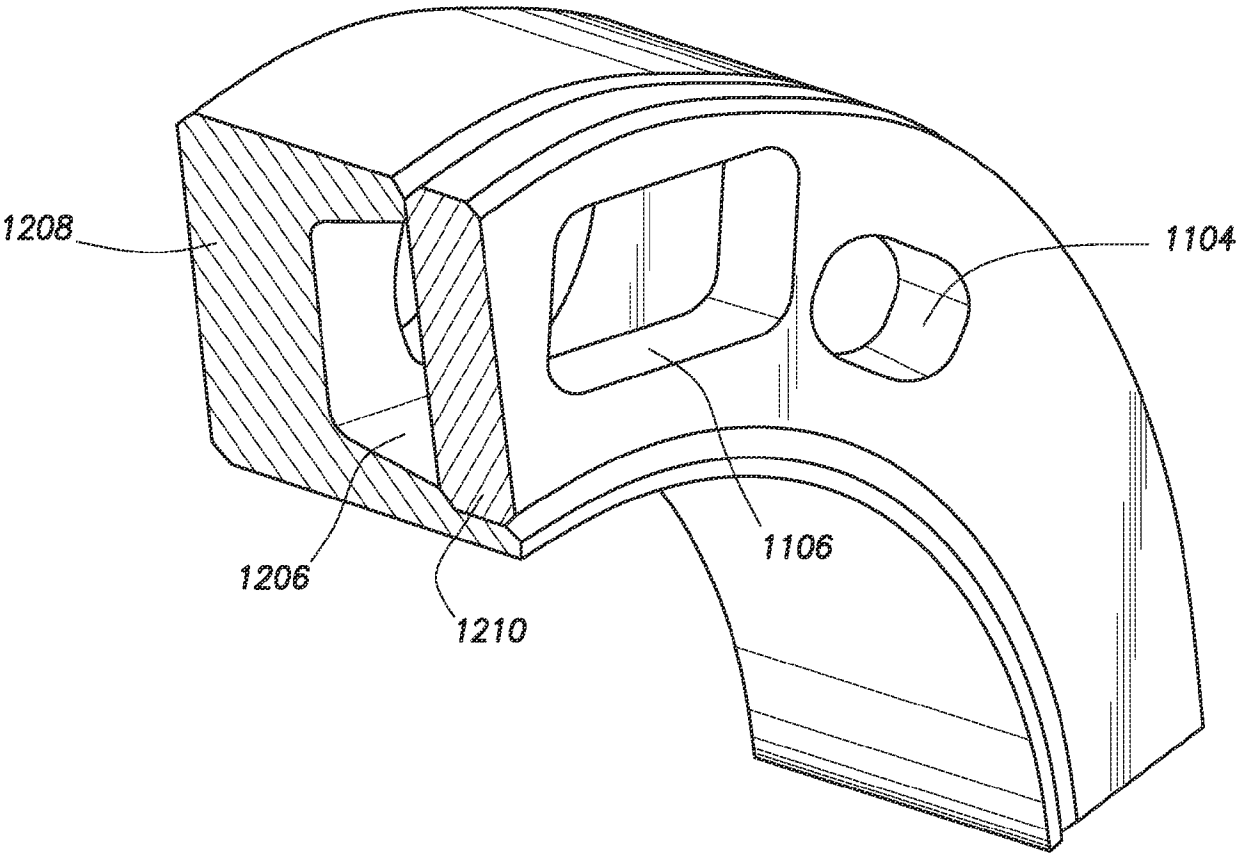

Another embodiment of a retaining ring 1101 comprising a plurality of body portions is illustrated in FIGS. 12C and 12D. In this embodiment, the first body portion 1208 may comprise the openings 1102 for coupling with one or more jumper tubes, which may have substantially round cross-sections at the coupling with the first body portion 1208. The second body portion 1210 may comprise the openings 1104, 1106 for coupling with one or more shunt tubes (e.g., transport tubes, packing tubes, etc.). The first body portion 1208 and the second body portion 1210 may be engaged and coupled using any suitable coupling mechanism. In an embodiment, the first body portion 1208 and the second body portion 1210 may be coupled using a welded coupling. One or more weldment surfaces 1212, 1214 may be disposed on the first body portion 1208 and/or the second body portion 1210 for receiving a weld. The use of the welded connection and the weldment surfaces 1212, 1214 disposed about the retaining ring 1101 surfaces may allow the orientation of the first body portion 1208 and the second body portion 1210 to be adjusted. For example, the first body portion 1208 may be somewhat misaligned with the second body portion 1210 while still allowing for the first body portion 1208 to be coupled to the second body portion 1210. Upon being coupled, one or both of the body portions 1208, 1210 may be fixedly attached to the wellbore tubular about which the retaining ring 1101 is disposed.

A partial isometric view of the retaining ring 1101 is illustrated in FIG. 12D. A chamber 1206 may be formed by the engagement of the first body portion 1208 with the second body portion 1210. The chamber may provide fluid communication between the openings 1102 and the openings 1104, 1106. When a single chamber is present, fluid communication may exist between each of the openings 1102 and each of the openings 1104, 1106. While the retaining ring 1101 illustrated in FIGS. 12C and 12D shows a single chamber 1206 being formed within the retaining ring 1101, a divider (not shown) may be disposed within the first body portion 1208 and/or the second body portion 1210. The divider may be configured to divide the chamber 1206 into two portions, thereby maintaining independent and redundant fluid communication pathways along the length of the shunt tube assembly.

Any of the configurations described herein with respect to the type and/or orientation of the jumper tubes, the retaining member, and/or the seal locations may also apply to the retaining member 1101. While described in terms of the jumper tube being coupled to a plurality of shunt tubes, the retaining member 1101 may also be used to couple a shunt tube to a plurality of jumper tubes. In this embodiment, the plurality of jumper tubes, which may comprise substantially round cross-sections at the coupling with the retaining member 1101, may then be coupled to corresponding shunt tubes, which may comprise non-round cross-sections, on an adjacent section of wellbore tubular.

Referring to FIGS. 4, 10, 11A-11C, and 12A-12D, the coupling process between the adjacent wellbore tubular joints 120, 520 may begin with coupling a first joint of wellbore tubular 120 comprising a shunt tube assembly to a second joint of wellbore tubular 520 comprising a shunt tube assembly. The wellbore tubular sections 120, 520 may generally comprise a pin and box type connection that can be threaded together and torqued according to standard connection techniques. Once coupled, the end 702 of a first shunt tube 706 on the first wellbore tubular joint 120 may be substantially aligned with the adjacent end 722 of a second shunt tube 726 on the second wellbore tubular joint 520.

Once the adjacent shunt tubes are substantially aligned, a first coupling member may be engaged with the first shunt tube, and a second coupling member may be coupled with a second shunt tube. In an embodiment, one or more of the coupling members may comprise a coupling member engaged with a plurality of shunt tubes. In an embodiment, the first coupling member may be configured to engage a single jumper tube and a single shunt tube (e.g., a transport tube). In this embodiment, the second coupling member may be configured to engage the jumper tube and a plurality of shunt tubes (e.g., one or more transport tubes and/or packing tubes), thereby forming the branched structure of the shunt tube assembly with the coupling member/retaining ring and the jumper tube. The coupling member comprising a plurality of openings for shunt tubes may then be used to distribute the sand or gravel slurry to the transport tubes and packing tubes.

The coupling member may comprise a separate component and/or a retaining ring as described herein. In this embodiment, the retaining ring may be pre-installed as part of the screen assembly, and may have one or more openings for engaging the jumper tube. In some embodiments, the coupling members may be pre-coupled to the shunt tubes. One or more seals (e.g., o-ring seals, etc.) may be used to provide a fluid tight connection between the shunt tubes and the respective coupling members. While described below in terms of the coupling members being separate from the retaining rings, the same or similar formation process may be used to couple the jumper tube to the retaining rings.

The jumper tube may then be coupled to the coupling members. For example, the jumper tube may be engaged with one of the coupling member. The opposite end of the jumper tube may then be extended (e.g., extended through a telescoping configuration) to engage the coupling member on the adjacent joint of wellbore tubular. In some embodiments, a jumper tube having a fixed length may be used. In this embodiment, the jumper tube may be engaged with the coupling member and displaced a sufficient distance to allow the opposite end of the jumper tube to be aligned and engaged with the second coupling member. The jumper tube may then be engaged with the coupling member a distance sufficient to form an engagement while maintaining the engagement with the first coupling member. One or more seals (e.g., o-ring seals, etc.) may be used to provide a fluid tight connection between the jumper tube and the coupling members. In some embodiments, one or more retaining mechanisms may be used to maintain the engagement of the jumper tube with the coupling members.

Similar jumper tubes and coupling members may be used to couple any additional shunt tubes (e.g., transport tubes, packing tubes, etc.) being fluidly coupled between the adjacent joints of wellbore tubulars 120, 520. Having fluidly coupled the shunt tubes and any additional tubes on the adjacent joints of wellbore tubulars 120, 520, an additional shroud 403 may be used to protect the jumper tubes. In an embodiment, the shroud 403 may be similar to the outer body member 208, and may be configured to be disposed about the jumper tube section to prevent damage to the jumper tubes, coupling members and ends of the adjacent shunt tubes during conveyance within the wellbore. Once the adjacent wellbore tubulars 120, 520 are coupled and the shroud 403 has been engaged, additional joints of wellbore tubulars may be similarly coupled to the existing joints and/or additional wellbore tubulars may be used to complete the assembled sand screen structure for use in the wellbore.

Figure 13:
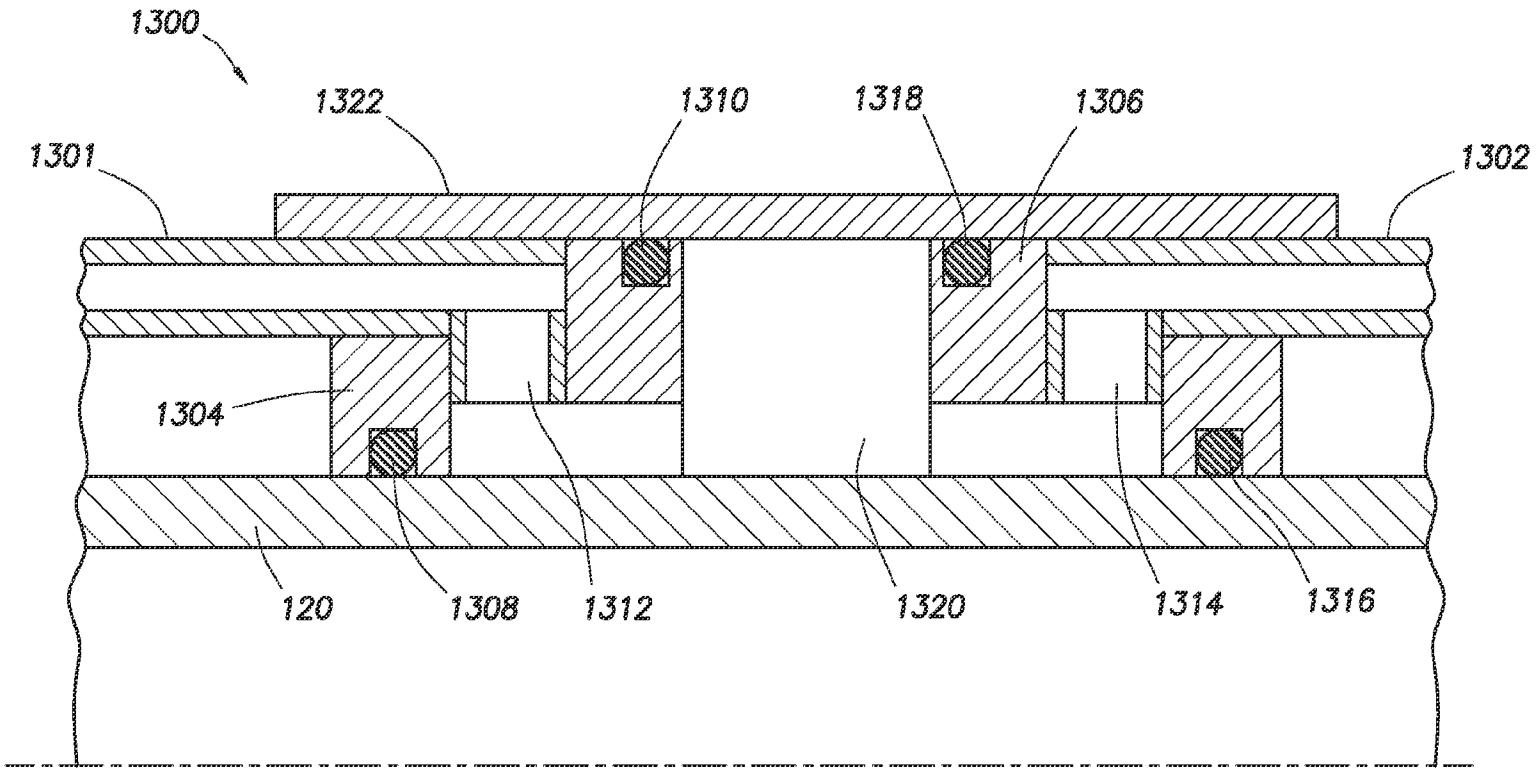
FIG. 13 is a schematic cross-sectional view of an embodiment of a coupling member.

In an embodiment, the coupling member may comprise a rotating and/or translating ring assembly. As shown in FIG. 13, the coupling member 1300 comprises two rings 1304, 1306. The first ring 1304 may generally comprise a ring and/or clamp configured to engage and be disposed about the wellbore tubular 120. The first ring 1304 may engage the wellbore tubular 120 using any suitable coupling including any of those described with respect to the retaining ring 212, as described in more detail herein. The first ring 1304 may be configured to rotate about the wellbore tubular 120, and in some embodiments, axially translate over at least a portion of the length of the wellbore tubular 120. One or more seals 1308, 1310 may be used to form a sealing engagement between the first ring 1304 and the wellbore tubular 120 and a cover 1322. One or more ports 1312 may be disposed between an exterior side of the first ring 1304 and an interior side of the first ring 1304. Similarly, a second ring 1306 may engage the wellbore tubular 120. The second ring 1306 may be configured to rotate about the wellbore tubular 120, and in some embodiments, axially translate over at least a portion of the length of the wellbore tubular 120. One or more seals 1316, 1318 may be used to form a sealing engagement between the second ring 1306 and the wellbore tubular 120 and a cover 1322. One or more ports 1314 may be disposed between an exterior side of the second ring 1306 and an interior side of the second ring 1306.

The combination of the first ring 1304, the second ring 1306, and the cover 1322 may form a chamber 1320 through which fluid communication is established between one or more jumper tubes 1301 and one or more shunt tubes 1302. One or more stops may be disposed on and/or about the wellbore tubular to limit the axial translation of the first ring 1304 and/or the second ring 1306 along the length of the wellbore tubular. In an embodiment, the first ring 1304 and/or the second ring 1306 may be fixedly coupled to the wellbore tubular 120.

The first ring 1304 may be configured to be coupled to one or more jumper tubes 1301 and/or the second ring 1306 may be configured to be coupled to one or more shunt tubes 1302. The coupling with the one or more jumper tubes 1301 may comprise a substantially round cross-section, and/or the coupling with the one or more shunt tubes 1302 may comprise a non-round cross-section. Thus, the combination of the first ring 1304 and the second ring 1306 may be used to adapt a non-round cross-section of one or more shunt tubes 1302 to a substantially round cross-section of the coupling portion of one or more jumper tubes 1301. Further the rotation and translation of the first ring 1304 and/or the second ring 1306 may allow for a misalignment of the shunt tubes on adjacent sections of wellbore tubular. For example, the first ring 1304 and/or the second ring 1306 may be rotated and/or axially translated into engagement with the one or more jumper tubes 1301 and one or more shunt tubes 1302, respectively.

In use, the first ring 1304 may be rotated about the wellbore tubular 120 and/or axially translated into engagement with the jumper tube 1301. The second ring 1306 may similarly be rotated about the wellbore tubular 120 and/or axially translated into engagement with the shunt tubes 1302. Upon being engaged with the respective tubes, the cover 1322 may be engaged with the first ring 1304 and the second ring 1306 to form the chamber 1320 and provide fluid communication between the tubes. The first ring 1304 and/or the second ring 1306 may then be optionally fixedly coupled to the wellbore tubular 120 to maintain the relative positions of the first ring 1304 and/or the second ring 1306.

Another embodiment of a coupling member comprising a rotating and/or translating ring assembly is illustrated in FIG.

Figure 14:
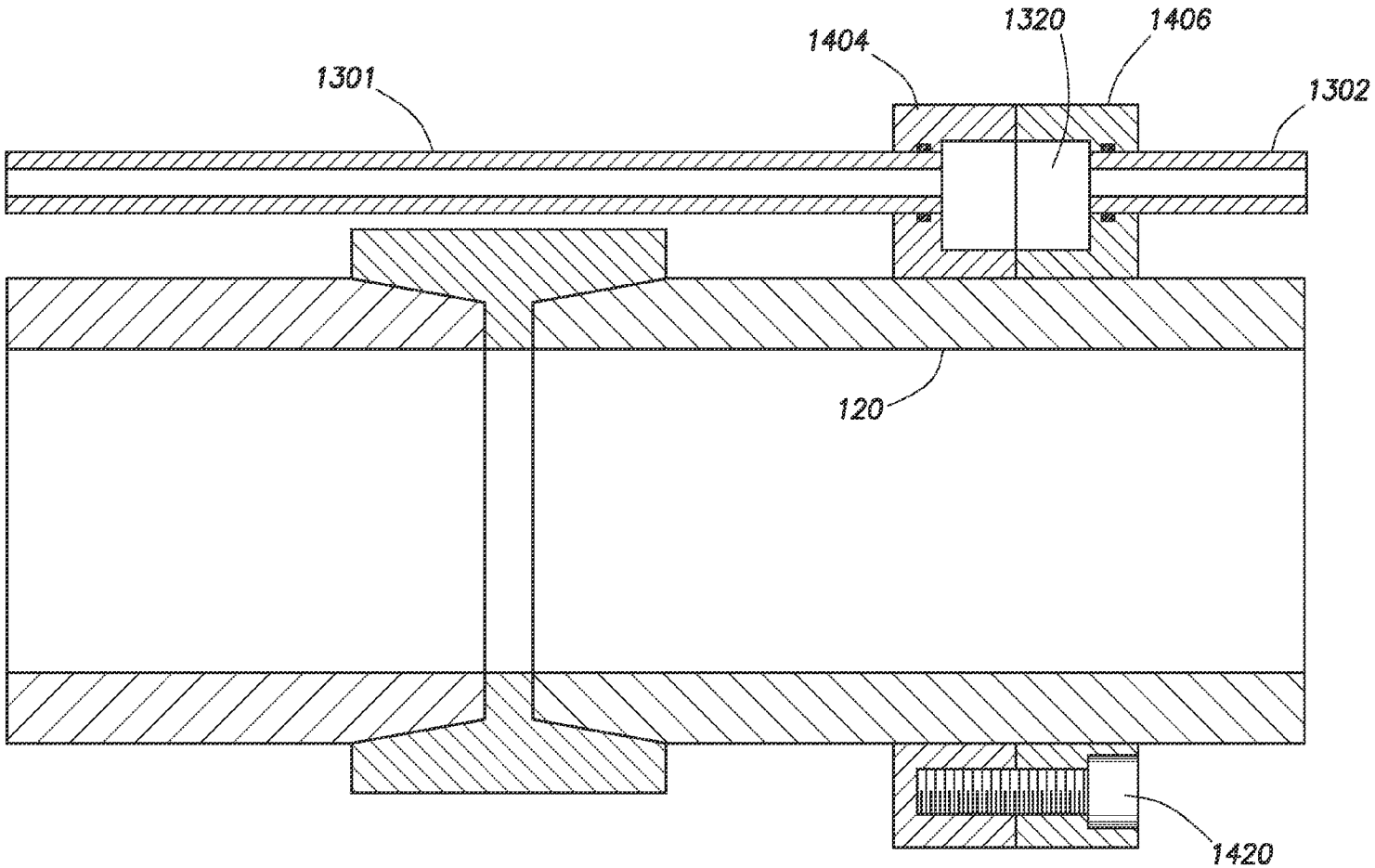
FIG. 14 is another schematic cross-sectional view of an embodiment of a coupling member.

14. The embodiment of FIG. 14 is similar to the embodiment illustrated in FIG. 13 and like components will not be discussed in the interest of clarity. In this embodiment, a first ring 1404 and a second ring 1406 may be disposed about the wellbore tubular 120, and the first ring 1404 and second ring 1406 may be configured to directly engage each other, thereby forming the chamber 1320. A coupling mechanism 1420 may be used to engage and couple the first ring 1404 to the second ring 1406. The engagement of the first ring 1404 with the second ring 1406 may form a sealing engagement. In an embodiment, the coupling mechanism may be configured to couple the first ring 1404 and the second ring 1406 regardless of the axial alignment of the rings 1404, 1406 and/or the one or more jumper tubes 1301 or one or more shunt tube 1302. This may allow the first ring 1404 and/or the second ring 1406 to be rotated about the wellbore tubular 120 to provide the appropriate alignment with the one or more jumper tubes 1301 and/or the one or more shunt tubes 1302 before being coupled together.

In use, the first ring 1304 may be rotated about the wellbore tubular 120 and into engagement with the jumper tube 1301. The second ring 1306 may similarly be rotated about the wellbore tubular 120 and into engagement with the shunt tubes 1302. Upon being engaged with the respective tubes, the coupling mechanism may be used to couple the first ring 1404 to the second ring 1406, which may form a sealing engagement between the rings 1404, 1406. The first ring 1404 and/or the second ring 1406 may then be optionally fixedly coupled to the wellbore tubular 120 to maintain the relative positions of the first ring 1404 and/or the second ring 1406.

In each of the embodiments of the couplings, coupling members, and/or retaining rings described herein may be used alone or in combination to provide an assembled shunt tube assembly. For example, a shunt tube assembly comprising a plurality of wellbore tubular joints may be coupled using any combination of the configurations described herein. Once assembled, any of the shunt tube assemblies described herein may be disposed within a wellbore for use in forming a sand screen. Referring again to FIG. 1, after the assembled sand screen structure is installed in the wellbore 114, a packing sand/gel slurry can be forced downwardly into the annulus between the casing and the sand screen to form the prefiltering sand pack around the screen structure. In the event that an annular sand bridge is created externally around the sand screen structure, the slurry is caused to bypass the sand bridge by flowing into the shunt tubes downwardly through the shunt tubes, and then outwardly into the casing/sand screen annulus beneath the sand bridge. When flowing through the shunt tubes, the packing sand/gel slurry may pass through one or more connections comprising jumper tubes coupled to one or more shunt tubes using the couplings, coupling members, and/or retaining rings described herein. Once the gravel pack has been formed as desired, a fluid may be allowed to flow through the gravel pack, through the slots in the outer body member, through the filter media, and into the throughbore of the wellbore tubular where it may be produced to the surface.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A shunt tube assembly comprising:

a shunt tube, wherein the shunt tube comprises a non-round cross section along its length, and wherein the shunt tube comprises a substantially round cross section at a first end of the shunt tube;

a jumper tube comprising a first end, wherein the first end of the jumper tube is coupled to the first end of the shunt tube at a coupling, wherein the first end of the jumper tube comprises a substantially round cross section at the coupling;

a first wellbore tubular; and a second wellbore tubular coupled to the first wellbore tubular at a wellbore tubular coupling, wherein the shunt tube is coupled to the first wellbore tubular, and wherein the jumper tube extends along the first wellbore tubular and the second wellbore tubular adjacent to the wellbore tubular coupling.

2. The shunt tube assembly of claim 1, further comprising a second shunt tube coupled to a second end of the jumper tube at a second coupling, wherein the second shunt tube comprises a non-round cross section along its length, and wherein the second end of the jumper tube comprises a substantially round cross section at the second coupling.

3. The shunt tube assembly of claim 1, wherein the jumper tube comprises a non-round cross section along its length.

4. The shunt tube assembly of claim 3, wherein the jumper tube maintains a substantially constant hydraulic diameter between the first end and a second end.

5. The shunt tube assembly of claim 3, wherein the non-round cross section of the jumper tube is disposed adjacent to the wellbore tubular coupling between the first wellbore tubular and the second wellbore tubular.

6. The shunt tube assembly of claim 3, wherein the non-round cross section of the jumper tube comprises a rectangular, oval, kidney shaped, trapezoidal, or squared cross section.

7. The shunt tube assembly of claim 1, wherein the jumper tube comprises a bend between the first end and a second end.

8. The shunt tube assembly of claim 1, wherein the jumper tube comprises a first tubular body and a second tubular body, wherein the first tubular body is configured to sealingly slidingly engage the second tubular body.

9. A shunt tube assembly comprising:

a shunt tube comprising a first cross-sectional shape at a first end of the shunt tube;

a jumper tube comprising a second cross-sectional shape at a first end of the jumper tube, wherein the jumper tube comprises a third cross-sectional shape along its length, wherein the second cross-sectional shape and the third cross-section shape are different, and wherein the first cross-sectional shape and the second cross-sectional shape are different;

a coupling member comprising a first end and a second end of the coupling member, wherein the coupling member is configured to provide a sealing engagement between the first end of the coupling member and the first end of the shunt tube, and wherein the coupling member is configured to provide a sealing engagement between the second end of the coupling member and the first end of the jumper tube; and a wellbore tubular coupling, wherein the jumper tube extends along and adjacent to the wellbore tubular coupling and wherein the jumper tube extends along the first wellbore tubular and the second wellbore tubular adjacent to the wellbore tubular coupling.

10. The shunt tube assembly of claim 9, wherein the second cross-sectional shape is a substantially round cross-sectional shape.

11. The shunt tube assembly of claim 9, wherein the first cross-sectional shape is a rectangular cross-sectional shape.

12. The shunt tube assembly of claim 9, further comprising one or more seals disposed between the coupling member and the shunt tube at the first end.

13. The shunt tube assembly of claim 9, further comprising one or more seals disposed between the coupling member and the jumper tube at the second end.

14. The shunt tube assembly of claim 9, further comprising:

a second shunt tube comprising a fourth cross-sectional shape; and a second coupling member comprising a third end and a fourth end, wherein the second coupling member is configured to provide a sealing engagement between the second coupling member and the second shunt tube at the third end, and wherein the second coupling member is configured to provide a sealing engagement between the second coupling member and the jumper tube at the second end.

15. The shunt tube assembly of claim 14, wherein the first cross-sectional shape and the fourth cross-sectional shape are the same.

16. The shunt tube assembly of claim 9, wherein the coupling member comprises an alignment ring.

17. A method of forming a shunt tube coupling comprising:

coupling a first wellbore tubular to a second wellbore tubular to form a wellbore tubular coupling, wherein a shunt tube is coupled to the first wellbore tubular;

aligning a first end of a jumper tube with the shunt tube, wherein the shunt tube comprises a non-round cross section along its length; and coupling the first end of the jumper tube to the shunt tube at a coupling, wherein the first end of the jumper tube comprises a substantially round cross section at the coupling, and wherein the jumper tube extends along and adjacent to the wellbore tubular coupling, and, wherein the jumper tube comprises a non-round cross section along its length, and wherein the non-round cross-section of the jumper tube comprises a rectangular, oval, kidney shaped, trapezoidal, or squared cross section.

18. The method of claim 17, further comprising: aligning a second end of the jumper tube with a second shunt tube, wherein the second shunt tube comprises a second non-round cross section; and coupling the second end of the jumper tube to the second shunt tube at a second coupling, wherein the second end of the jumper tube comprises a substantially round cross-section at the second coupling.

19. The method of claim 17, wherein the jumper tube comprises a bend between the first end and a second end.

* * * * *